US005921048A

United States Patent [19]

Francom et al.

[11] Patent Number: 5,921,048

[45] Date of Patent: Jul. 13, 1999

[54] THREE-DIMENSIONAL ISO-TROSS STRUCTURE

[75] Inventors: Larry R. Francom, Price; David W. Jensen, Mapleton, both of Utah

[73] Assignee: Brigham Young University, Provo, Utah

[21] Appl. No.: 08/838,599

[22] Filed: Apr. 10, 1997

Related U.S. Application Data

[60] Provisional application No. 60/015,610, Apr. 18, 1996.

[51] Int. Cl.[6] ..... E04H 12/00; B65H 81/00

[52] U.S. Cl. ..... 52/637; 52/651.11; 52/652.1; 52/665; 52/DIG. 7; 52/DIG. 10; 242/437.3; 242/445.1

[58] Field of Search ..... 52/633, 637, 648.1, 52/651.11, 652.1, 653.1, 655.1, 660, 664, 665, DIG. 7, DIG. 10; 156/425, 430, 432, 433; 242/437.3, 445.1, 447

[56] References Cited

U.S. PATENT DOCUMENTS

| | | | |
|---|---|---|---|
| 1,798,064 | 3/1931 | Chorlton et al. | 52/648.1 X |
| 1,922,269 | 8/1933 | Wickwire, Jr. | 52/660 X |
| 3,501,880 | 3/1970 | Bosch | 52/651.11 X |
| 3,798,864 | 3/1974 | Georgii | 52/651.11 |
| 4,077,828 | 3/1978 | Strom | 156/432 X |
| 4,137,354 | 1/1979 | Mayes, Jr. . | |
| 4,722,162 | 2/1988 | Wilensky | 52/652.1 |
| 4,786,341 | 11/1988 | Kobatake et al. | 52/DIG. 7 X |
| 4,803,824 | 2/1989 | Coppa | 52/DIG. 10 X |
| 5,197,254 | 3/1993 | Smith | 52/653.1 |

OTHER PUBLICATIONS

First Joint U.S./Japan Conference on Adaptive Structures, Nov. 13–15, 1990, Maui, Hawaii, U.S.A., Technomic Publishing Co., Inc.

Second Joint Japan/U.S. Conference on Adaptive Structures, Nov. 12–14, 1991, Nagoya, Japan, Technomic Publishing Co., Inc.

AGARD Conference Proceedings 531, Smart Structures for Aircraft and Spacecraft, Oct. 5–7, 1992, Lindau, Germany.

37th AIAA/ASME/ASCE/AHS/ASC Structures, Structural Dynamics, and Materials Conference, Apr. 15–17, 1996, Salt Lake City, Utah, U.S.A., pp. 1868–1873.

*Primary Examiner*—Carl D. Friedman
*Assistant Examiner*—Kevin D. Wilkens
*Attorney, Agent, or Firm*—Thorpe, North & Western, LLP

[57] ABSTRACT

A structural member having greatly enhanced load bearing capacity per unit weight has a plurality of helical components wrapped around a longitudinal axis. The helical components have straight segments rigidly connected end to end in a helical configuration. In a basic repeating unit, three helical components have a common angular orientation, a common longitudinal axis, and are spaced apart from each other at equal distances. Another three reverse helical components also have a common angular orientation, a common longitudinal axis, and are spaced apart from each other at equal distances, but have an opposing angular orientation. These six helical components appear as a triangle when viewed along the axis due to the straight segments. An additional six helical are configured as above but rotated with respect to the first six components such that the member appears as a six-pointed star when viewed from the axis.

24 Claims, 22 Drawing Sheets

THREE-DIMENSIONAL ISO-TROSS STRUCTURE

This application claims the benefit of U.S. Provisional Application No. 60/015,610, filed Apr. 18, 1996.

BACKGROUND OF THE INVENTION

1. Field of the Invention

The present invention relates to a three-dimensional structural member having enhanced load bearing capacity per unit mass. More particularly, the present invention relates to a structural member having a plurality of helical components wrapped around a longitudinal axis where the components have straight segments rigidly connected end to end.

2. Prior Art

The pursuit of structurally efficient structures in the civil, mechanical, and aerospace arenas is an ongoing quest. An efficient truss structure is one that has a high strength to weight ratio and/or a high stiffness to weight ratio. An efficient truss structure can also be described as one that is relatively inexpensive, easy to fabricate and assemble, and does not waste material.

Trusses are typically stationary, fully constrained structures designed to support loads. They consist of straight members connected at joints at the end of each member. The members are two-force members with forces directed along the member. Two-force members can only produce axial forces such as tension and compression forces in the member. Trusses are often used in the construction of bridges and buildings. Trusses are designed to carry loads which act in the plane of the truss. Therefore, trusses are often treated, and analyzed, as two-dimensional structures. The simplest two-dimensional truss consists of three members joined at their ends to form a triangle. By consecutively adding two members to the simple structure and a new joint, larger structures may be obtained.

The simplest three-dimensional truss consists of six members joined at their ends to form a tetrahedron. By consecutively adding three members to the tetrahedron and a new joint, larger structures may be obtained. This three dimensional structure is known as a space truss.

Frames, as opposed to trusses, are also typically stationary, fully constrained structures, but have at least one multi-force member with a force that is not directed along the member. Machines are structures containing moving parts and are designed to transmit and modify forces. Machines, like frames, contain at least one multi-force member. A multi-force member can produce not only tension and compression forces, but shear and bending as well.

Traditional structural designs have been limited to one or two-dimensional analyses resisting a single load type. For example, I-beams are optimized to resist bending and tubes are optimized to resist torsion. Limiting the design analysis to two dimensions simplifies the design process but neglects combined loading. Three-dimensional analysis is difficult because of the difficulty in conceptualizing and calculating three-dimensional loads and structures. In reality, many structures must be able to resist multiple loadings. Computers are now being utilized to model more complex structures.

Advanced composite structures have been used in many types of applications in the last 20 years. A typical advanced composite consists of a matrix reinforced with continuous high-strength, high-stiffness oriented fibers. The fibers can be oriented so as to obtain advantageous strengths and stiffness in desired directions and planes. A properly designed composite structure has several advantages over similar metal structures. The composite may have a significantly higher strength-to-weight and stiffness-to-weight ratios, thus resulting in lighter structures. Methods of fabrication, such as filament winding, have been used to create a structure, such as a tank or column much faster than one could be fabricated from metal. A composite can typically replace several metal comoponents due to advantages in manufacturing flexibility.

U.S. Pat. No. 4,137,354, issued Jan. 30, 1979, to Mayes et al. discloses a cylindrical "iso-grid" structure having a repeated isometric triangle formed by winding fibers axially and helically. The grid, however, is tubular instead of flat or straight. In other words, the members are curved. This reduces the buckling strength of the members as compared to a straight member.

Therefore, it would be advantageous to develop a structural member having enhanced load bearing capacity per unit mass and capable of withstanding multiple loadings.

OBJECTS AND SUMMARY OF THE INVENTION

It is an object of the present invention to provide a three-dimensional structural member having enhanced load bearing capacity per unit mass.

It is another object of the present invention to provide a structural member capable of withstanding multiple loadings.

It is yet another object of the present invention to provide a structural member suitable for reinforcing concrete.

It is yet another object of the present invention to provide a structural member suitable for structural applications such as beams, cantilevers, supports, columns, spans, etc.

It is a further object of the present invention to provide a structural member suitable for architectural applications.

Still another object of the present invention is to provide a structural member suitable for mechanical applications, such as drive shafts.

These and other objects and advantages of the present invention are realized in a structural member comprising a plurality of helical components wrapped around a longitudinal axis. The helical components have straight segments that are rigidly connected end to end in a helical configuration.

In the preferred embodiment, the structural member has at least twelve helical components. At least three of the helical components wrap around the axis in one direction while another at least three, reverse helical components, wrap around in the opposite direction. The first at least three helical components have the same angular orientation and are spaced apart from each other at equal distances. The reverse helical members are similarly arranged but with an opposing angular orientation. The components cross at external nodes at the perimeter of the member and at internal nodes. When viewed from the axis, the straight segments of the components appear as a triangle. The remaining six components are arranged as the first six components but are rotated with respect to the first six components. When viewed from the axis, the member appears as two triangles with one triangle rotated with respect to the other, or as a six-pointed star. The member also appears as a plurality of triangles spaced away from the axis around the perimeter of the member and forming a polyhedron at the interior of the member. The components intersect to form external and internal nodes. In this embodiment, all the components share a common axis.

Additional members may be added to this structure. Internal axial members intersect the components at internal nodes and are parallel with the axis. External axial members intersect the components at external nodes and are also parallel with the axis. Perimeter members extend between adjacent external nodes perpendicular to the axis. Diagonal perimeter members extend between external nodes at a diagonal with respect to the axis.

In the preferred embodiment, three straight segments are formed as a helical component and make a single rotation about the axis, thus forming the appearance of a triangle when viewed along the axis. Alternatively, the helical components may form additional segments and the appearance of other polyhedrons when viewed along the axis. In one alternative embodiment, twenty four helical components form the appearance of two hexagons with one rotated with respect to the other when viewed from the axis. Six helical components wrap one way while six other, reverse helical components, wrap the other way. The remaining twelve components are similarly configured only rotated with respect to the first twelve.

In another alternative embodiment, a beam member has a similar configuration as the preferred embodiment, but with the axis of the first six components offset from the second six components.

Although the member may be constructed of any material, the helical configuration is well suited for composite construction. The fibers may be wrapped around a mandrel generally conforming to the helical patterns of the member. This adds strength to the member because the segments of a component are formed of a continuous fiber.

Two or more members may be connected by attaching the members at nodes. In addition, the member may be covered with a material to create the appearance of a solid structure or to protect the member or its contents.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Figure 1:
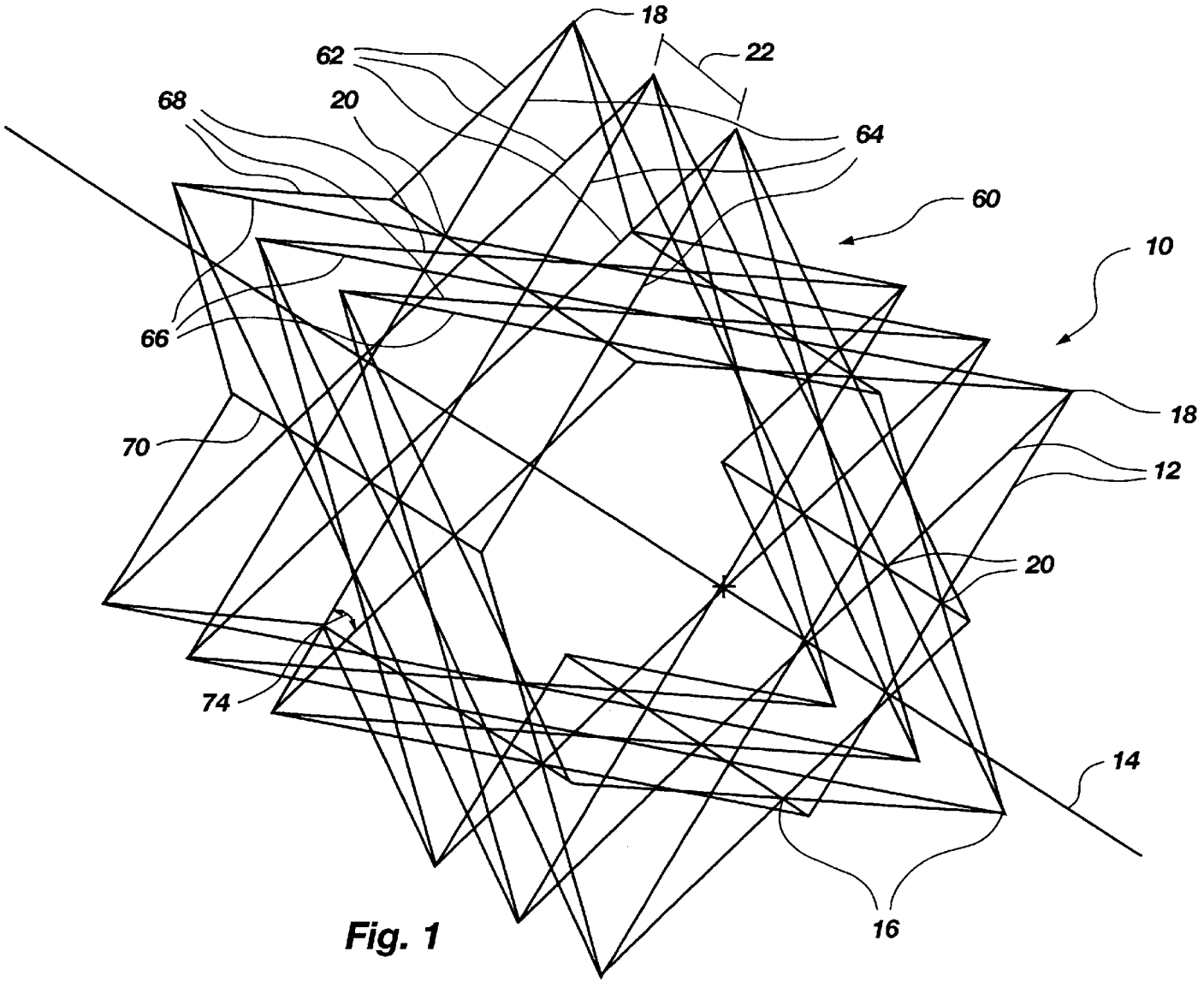
FIG. 1 is a perspective view of a preferred embodiment of a structural member of the present invention.

Reference will now be made to the drawings in which the various elements of the present invention will be given numerical designations and in which the invention will be discussed so as to enable one skilled in the art to make and use the invention.

As illustrated in FIGS. 1–4, a structural member 10 of the present invention is shown in a preferred embodiment. The structural member 10 is a three-dimensional truss or space frame. The structural member 10 is composed of a plurality of elements or members 12 arranged in a repeating pattern along the length or longitudinal axis 14 of the member 10.

Two or more single elements 12 connect or intersect at joints 16. The elements 12 may be rigidly connected, flexibly connected, or merely intersect at the joints 16. A node is formed where intersecting elements are connected. An external node 18 is formed where intersecting elements 12 meet at the perimeter of the member 10. An internal node 20 is formed where intersecting elements 12 meet at the interior of the member 10.

A bay 22 is formed by a repeating unit or pattern measured in the direction of the longitudinal axis 14. A bay 22 contains a single pattern formed by the elements 12. The member 10 may comprise any number of bays 22. In addition, the length of the bay 22 may be varied.

An internal angle 24 is formed by a plane created by two corresponding elements 12 of a tetrahedron and a plane created by opposing elements of the same tetrahedron.

The structure and geometry of the preferred embodiment of the structural member 10 may be described in numerous ways. The repeating pattern may be described as a number of triangles or tetrahedrons. The triangles and tetrahedrons are of various sizes with smaller triangles and tetrahedrons being interspersed among larger triangles and tetrahedrons.

In the preferred embodiment of the structural member 10, the triangles or tetrahedrons are formed by planes having an internal angle of 60 degrees. The internal angle may be varied depending on the application involved. It is believed that an internal angle of 60 degrees is optimal for multiple loadings. It is also believed that an internal angle of 45 degrees is well suited for torsional applications.

Figure 2:
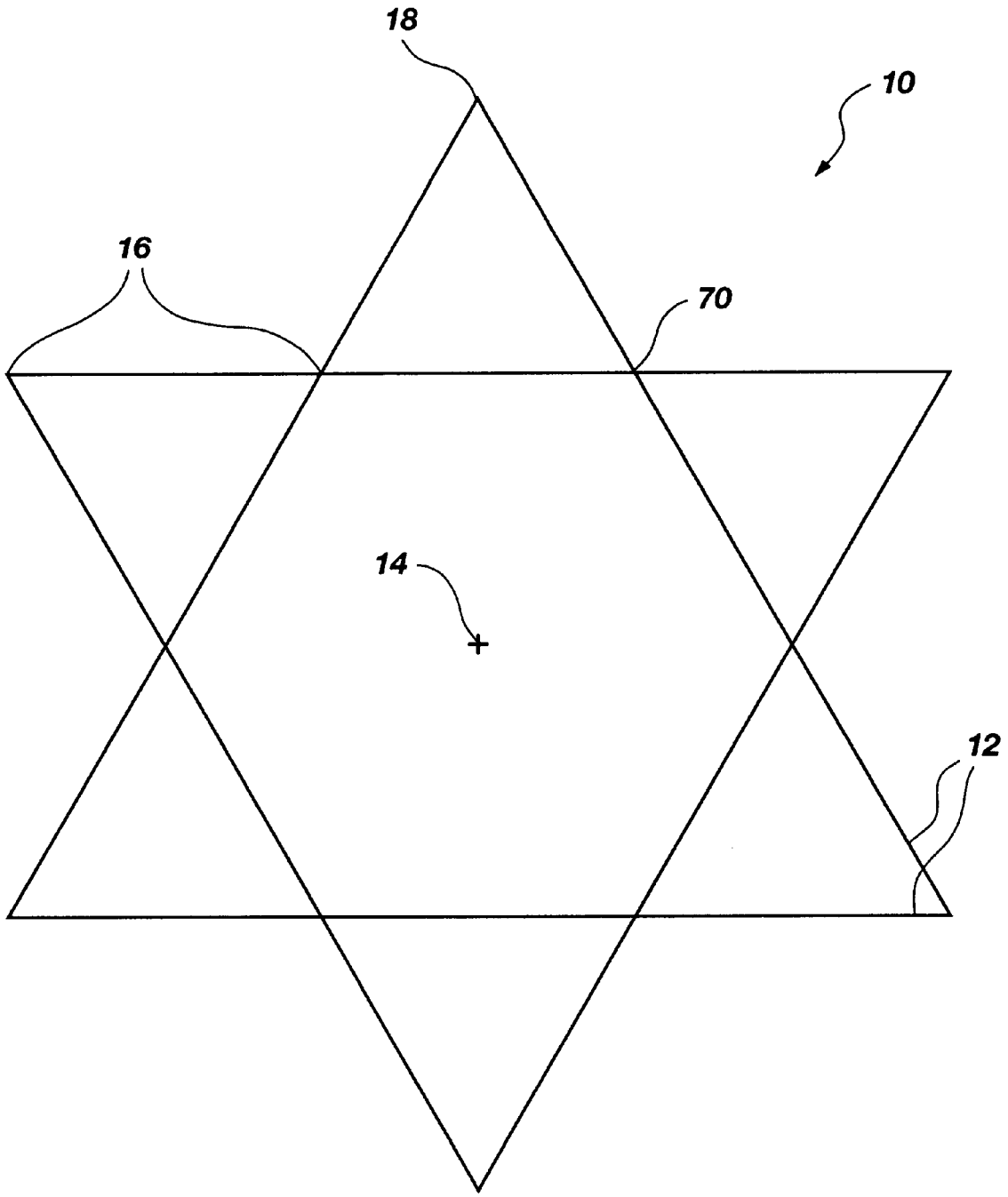
FIG. 2 is an end view of a preferred embodiment of a structural member of the present invention.

The structural member 10 of the preferred embodiment may be conceptualized as two, imaginary tubular members of triangular cross section overlaid to form a single imaginary tube with a cross section like a six-pointed star, as shown in FIG. 2. Or, when viewed from the end or longitudinal axis 14, the member 10 has the appearance of a plurality of triangles spaced from the axis 14 and oriented about a perimeter to form an imaginary tubular member of polyhedral cross section in the interior of the member 10. In the case of the preferred embodiment, six equilateral triangles are spaced about the longitudinal axis to form an imaginary tubular member of hexagonal cross section in the interior of the member 10.

In addition, when viewed from the end or the axis 14, it is possible to define six planes parallel with the axis 14. The planes extend between specific external nodes 18 in a six-pointed star configuration. The planes are oriented about the axis 14 at 60 degree intervals.

Figure 3:
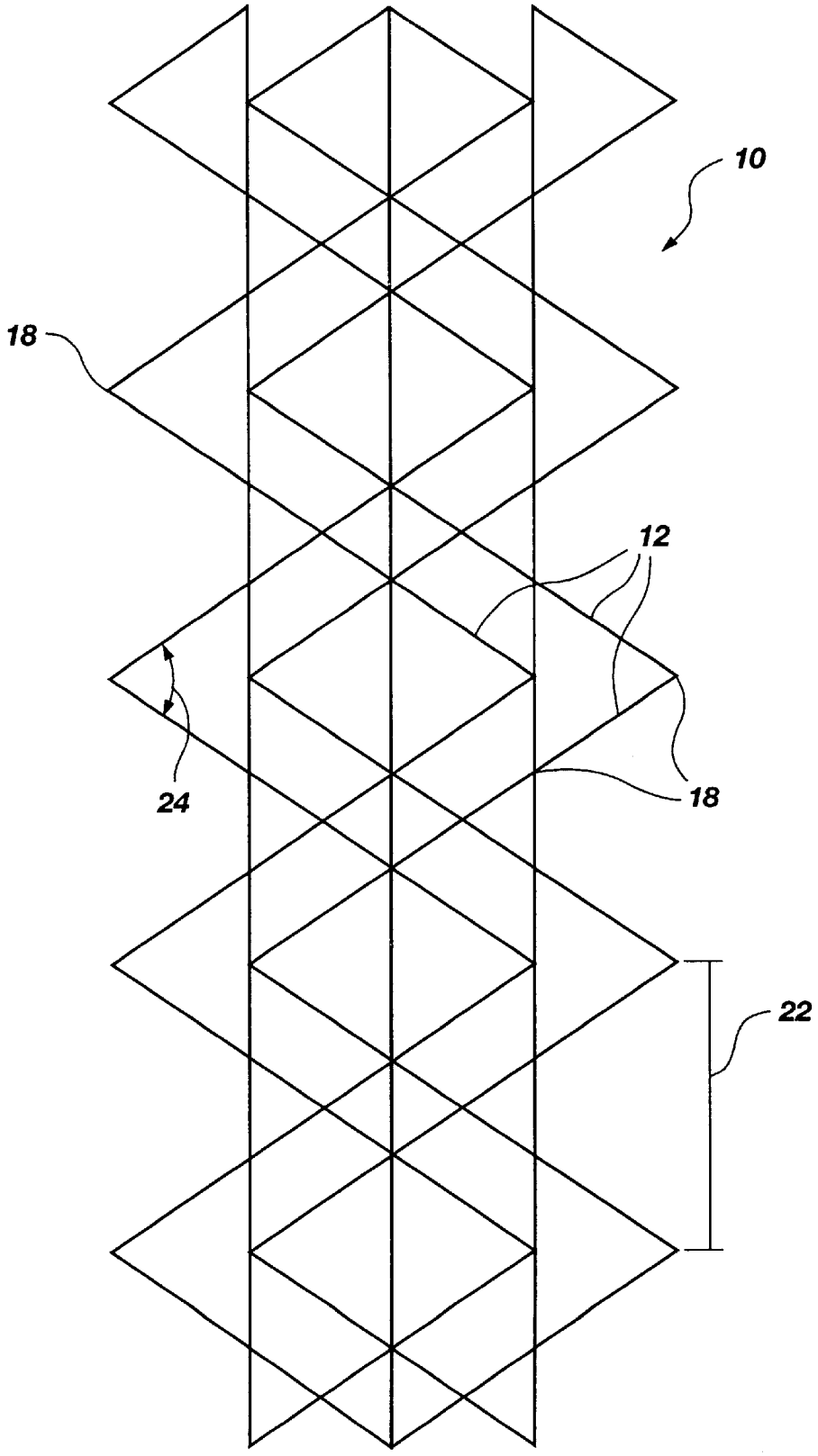
FIG. 3 is a front view of a preferred embodiment of a structural member of the present invention.
Figure 4:
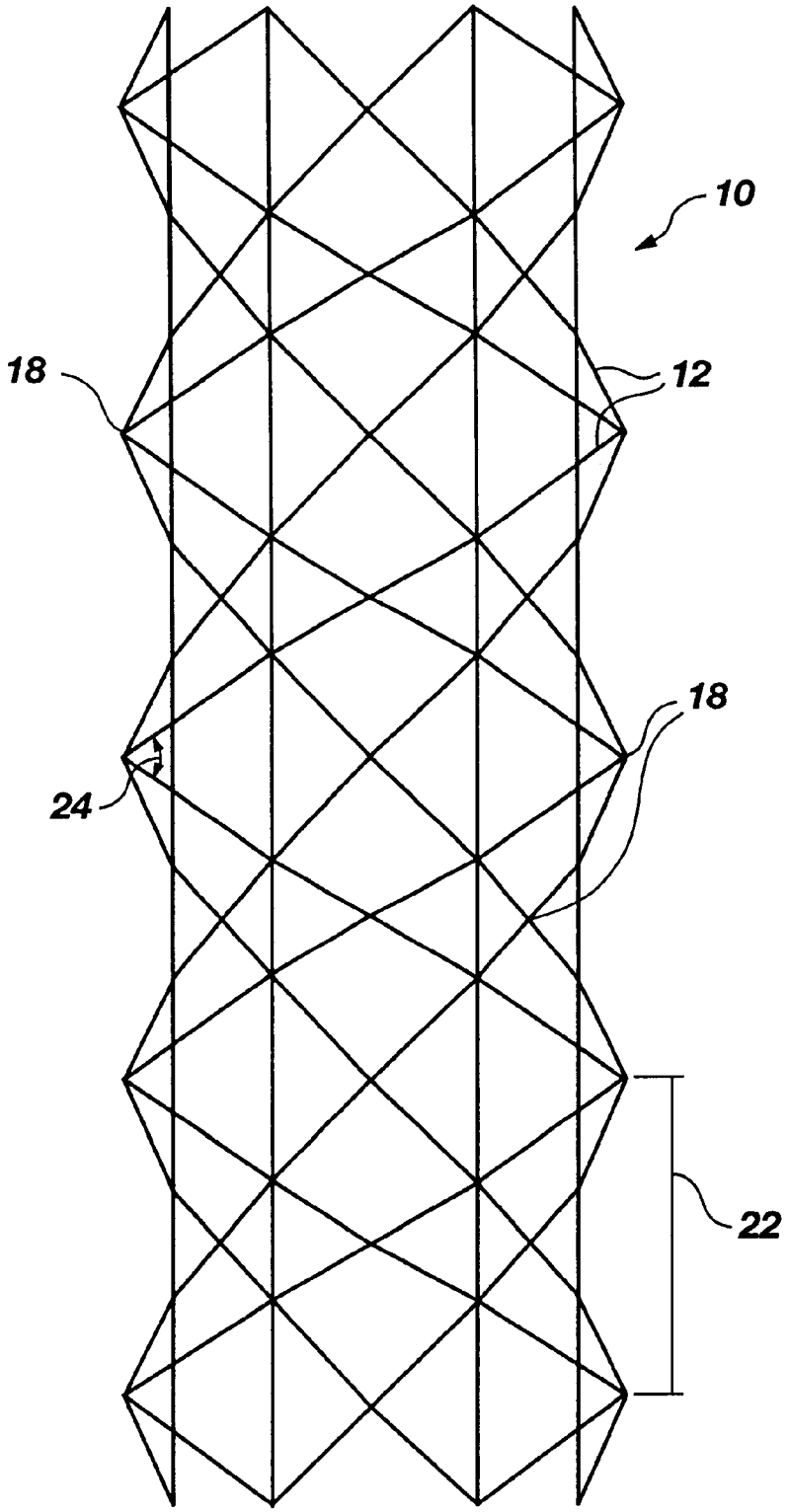
FIG. 4 is a side view of a preferred embodiment of a structural member of the present invention.

Furthermore, within a bay 22, a ring of triangular grids is formed which are believed to have strong structural properties. This ring of triangular grids circle the interior of the member 10 in the center of the bay, as shown in FIGS. 1, 3 and 4. It is believed that this strength is due to a greater number of connections.

Figure 5:
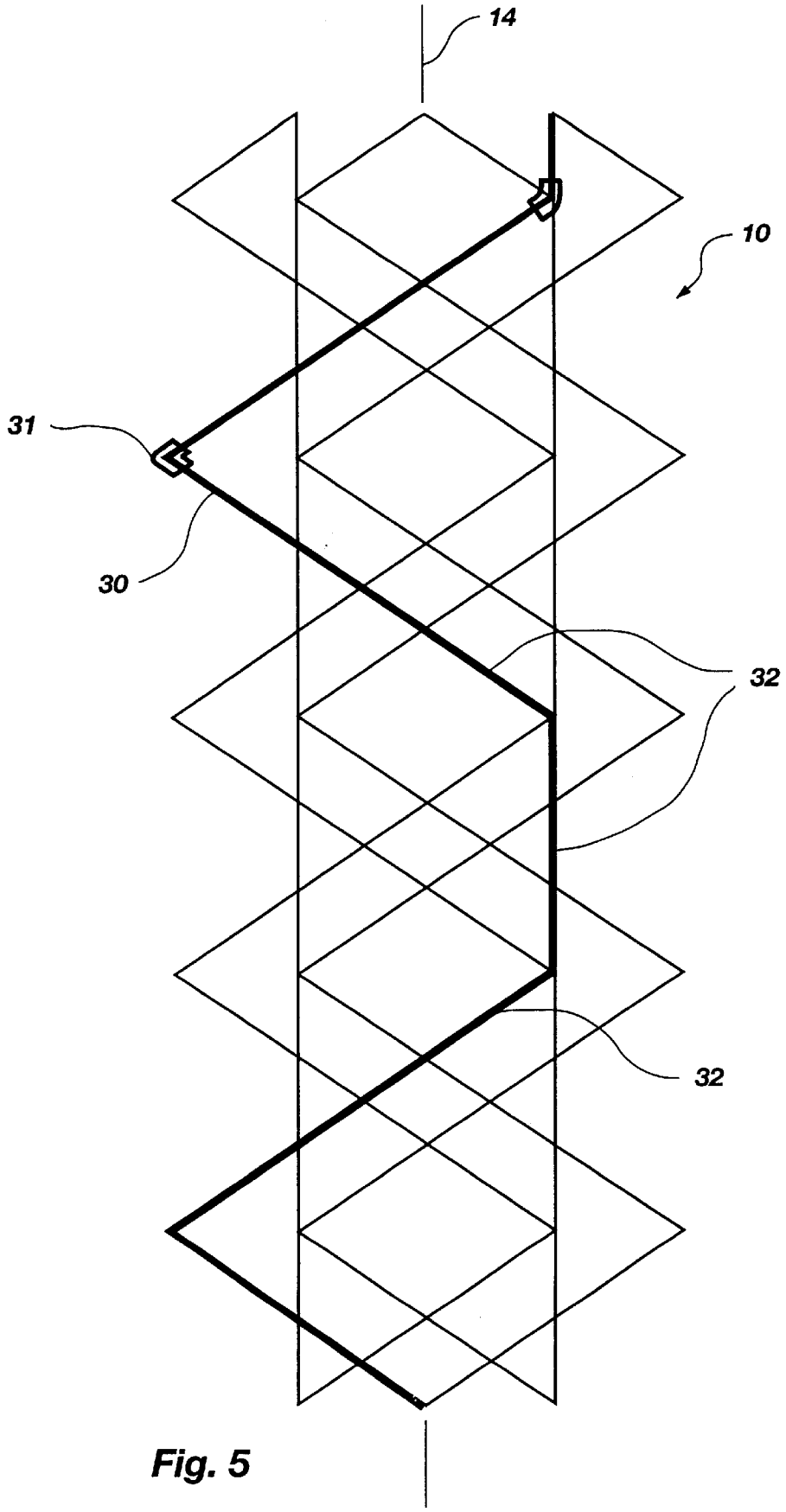
FIG. 5 is a front view of a structural member of the present invention with a single helix highlighted.
Figure 6:
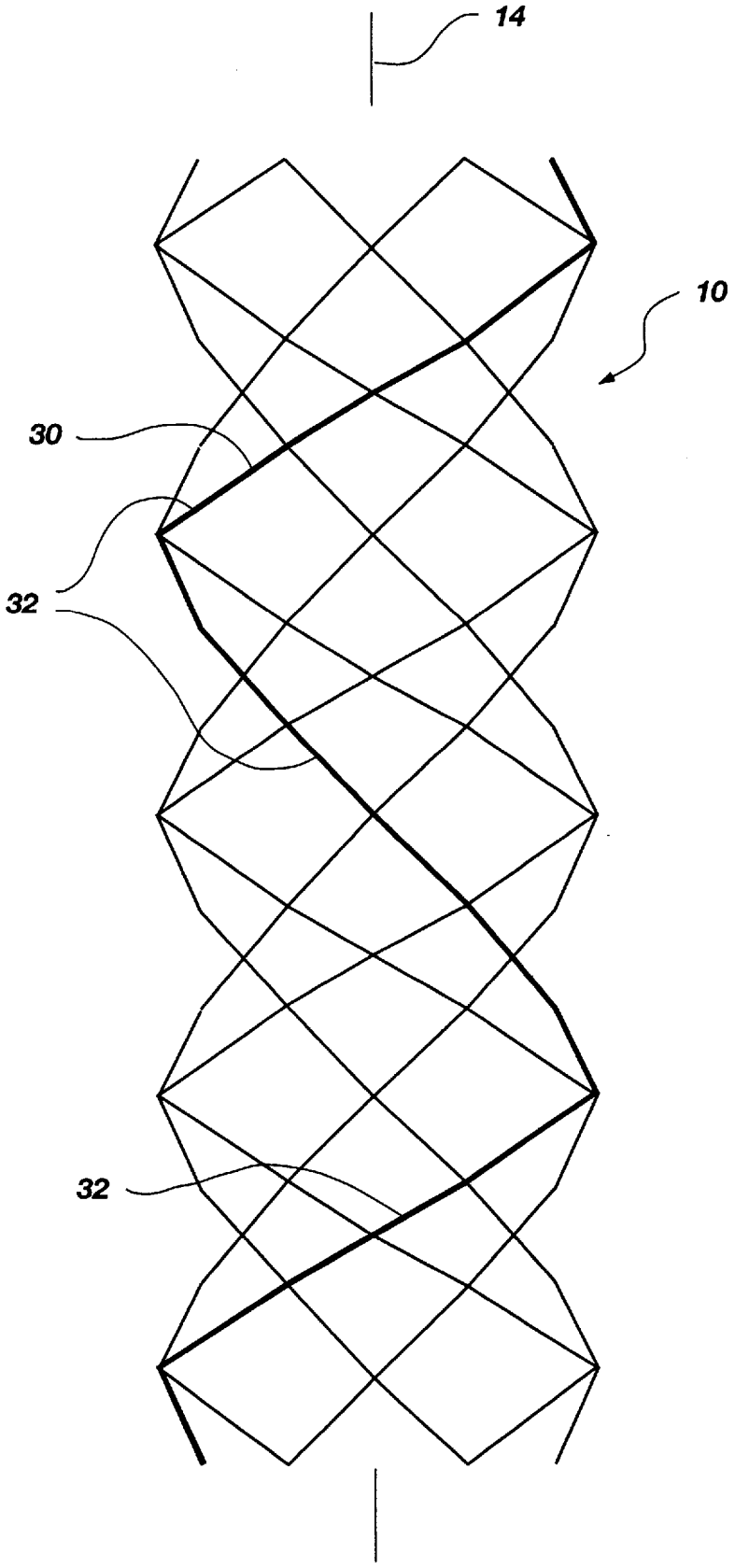
FIG. 6 is a side view of a structural member of the present invention with a single helix highlighted.

Furthermore, the member 10 of the preferred embodiment may be conceptualized and described as a plurality of helical components 30 wrapping about the longitudinal axis 14 and having straight segments 32 forming the elements 12 of the member 10. Referring to FIGS. 5 and 6, a single helical component 30 is shown in highlight. The helical component 30 forms at least three straight segments 32 as it wraps around the axis 14. The helical component 30 may continue indefinitely forming any number of straight segments 32. The straight segments 32 are oriented at an angle with respect to the axis 14. The straight segments 32 are rigidly connected end to end in a helical configuration.

Figure 7:
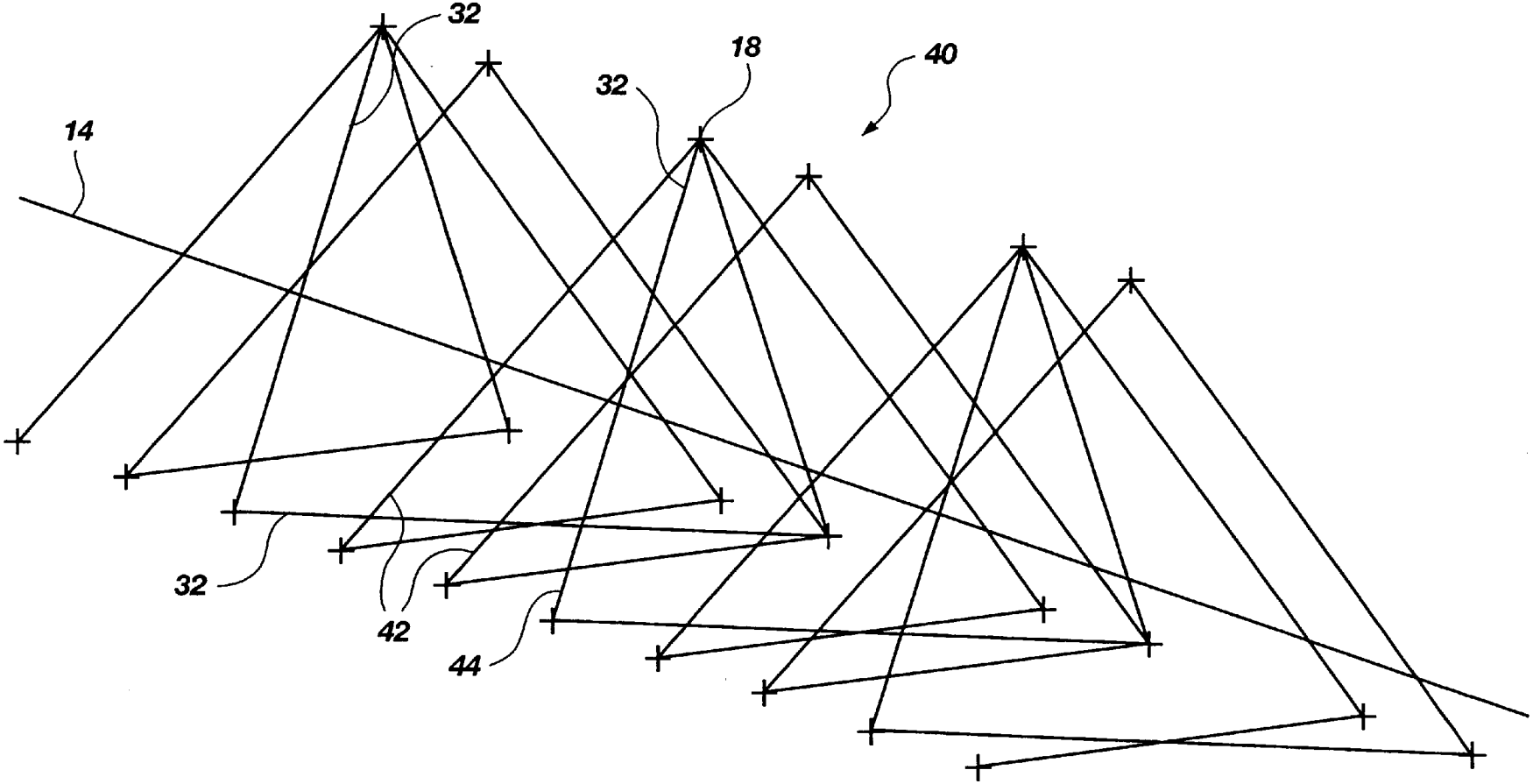
FIG. 7 is a perspective view of the basic structure of a preferred embodiment of the structural member of the present invention.

As illustrated in FIG. 7, the basic structure 40 of the member 10 of the preferred embodiment of the present invention has at least two helical components 42 and at least one reverse helical component 44 wrapping around the axis 14. The helical components 42 wrap around the axis 14 in one direction, for example clockwise, while the reverse helical component 44 wraps around the axis 14 in the opposite direction, for example counterclockwise. Each helical component 42 and 44 forms straight segments 32. The straight segments of the helical components 42 have a common angular orientation and a common axis 14. The straight segments of the reverse helical component 44 have a similar helical configuration to the segments of the helical components 42, but an opposing angular orientation. This basic structure 40, when viewed from the end or axis 14, appears as an imaginary tubular member of triangular cross section.

The reverse helical component 44 intersects the two helical components 42 at external nodes 18 and internal nodes 20. In the preferred embodiment, the external and internal nodes 18 and 20 form rigid connections or are rigidly coupled.

Figure 8:
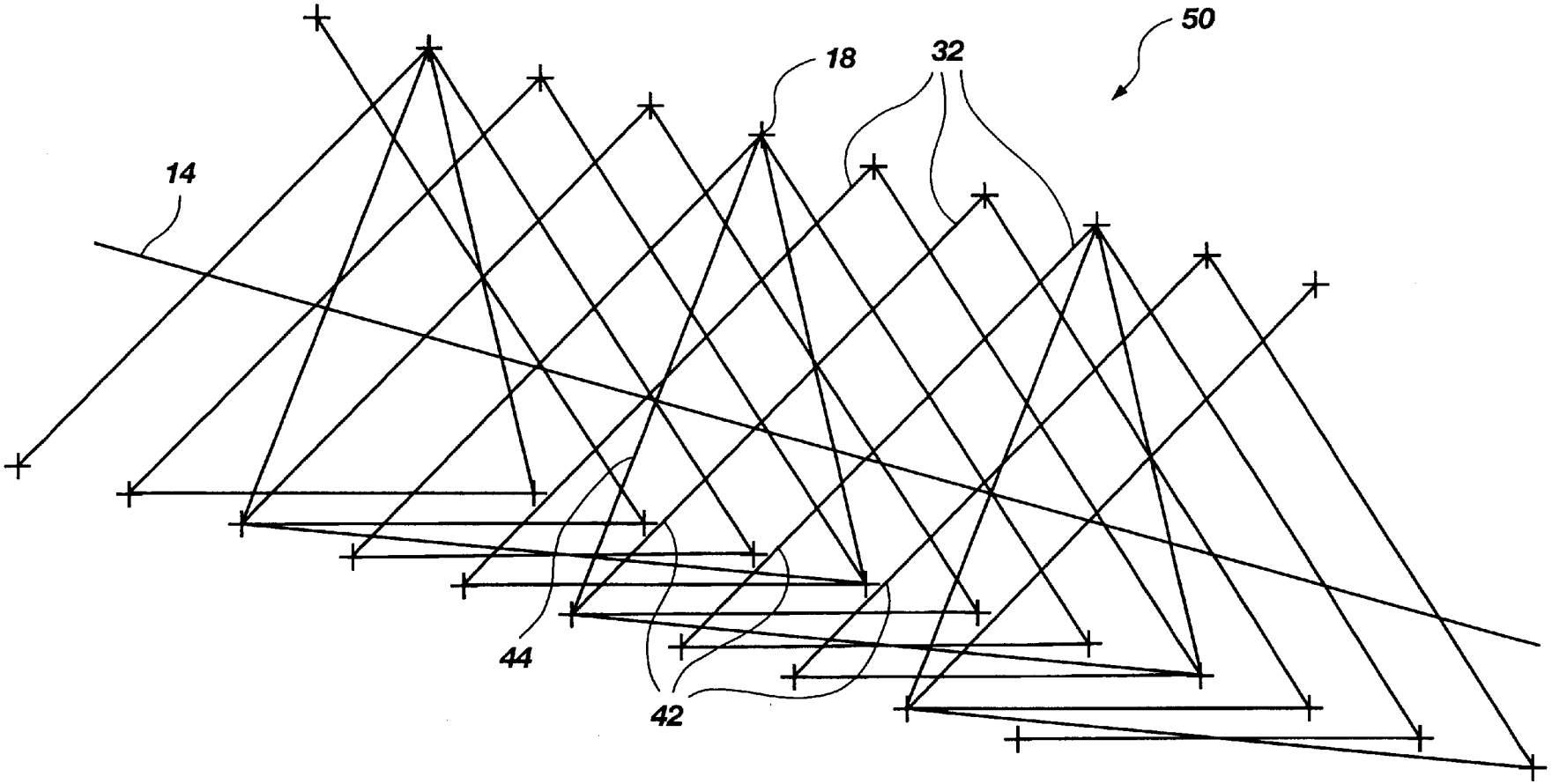
FIG. 8 is a perspective view of the basic structure of a preferred embodiment of the structural member of the present invention with an additional helix.
Figure 9:
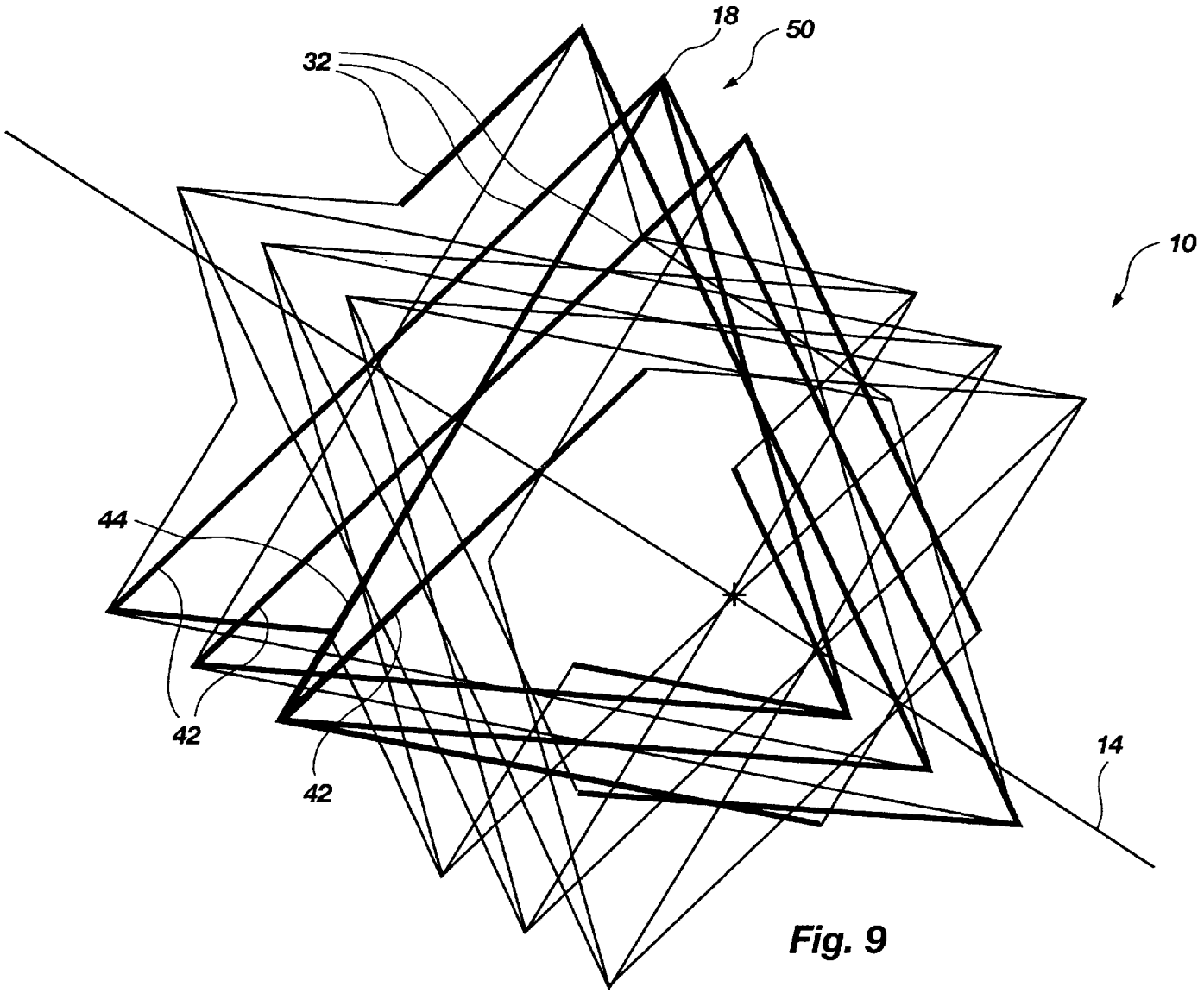
FIG. 9 is a perspective view of a preferred embodiment of the structural member of the present invention with three helical components and one reverse helical component highlighted.

As illustrated in FIG. 8, building on the basic structure 40 of FIG. 7 described above, an enhanced basic structure 50 of the member 10 has three helical components 42 and at least one reverse helical component 44. The straight segments 32 of the three helical components 42 have a common angular orientation, a common axis 14, and are spaced apart from each other at equal distances. Referring to FIG. 9, this enhanced basic structure 50 of three helical components 42 and one reverse helical component 44 is shown highlighted on the member 10 of the preferred embodiment.

As illustrated in FIG. 1, in the preferred embodiment, the member 10 has a plurality of helical components 60: three helical components 62, three reverse helical components 64, three rotated helical components 66, and three rotated reverse helical components 68. Thus, the member 10 has a total of twelve helical components 60 in the preferred embodiment.

As described above, the straight segments of the three helical components 62 have a common angular orientation, a common axis 14, and are spaced apart from each other at equal distances. Similarly, the segments of the three reverse helical components 64 have a common angular orientation, a common axis 14, and are spaced apart from each other at equal distances. But the straight segments of the three reverse helical components 64 have an opposing angular orientation to the angular orientation of the segments of the three helical components 62. Again, this structure, when viewed from the end or axis 14, appears as an imaginary tubular member of triangular cross section, as shown in FIG. 2.

The straight segments of the three rotated helical components 66 have a common angular orientation, a common axis 14, and are spaced apart from each other at equal distances, like the helical components 62. The segments of the three rotated reverse helical components 68 have a common angular orientation, a common axis 14, and are spaced apart from each other at equal distances, like the reverse helical components 64. But the straight segments of the three rotated reverse helical components 68 have an opposing angular orientation to the angular orientation of the segments of the three rotated helical components 66.

The rotated helical components 66 and the rotated reverse helical components 68 are rotated with respect to the helical components 62 and reverse helical components 64. In other words, this structure, when viewed from the end or axis 14, appears as an imaginary tubular member of triangular cross section, but is rotated with respect to the imaginary tubular member created by the helical and reverse helical components 62 and 64, as shown in FIG. 2. Together, the helical, reverse helical, rotated helical, and rotated reverse helical components appear as an imaginary tubular member having a six-pointed star cross section when viewed from the axis 14, as shown in FIG. 2.

The helical components 62 intersect with reverse helical components 64 at external nodes 18. Similarly, rotated helical components 66 intersect with rotated reverse helical components 68 at external nodes 18.

The helical components 62 intersect with rotated reverse helical components 68 at internal nodes 20. Similarly, the rotated helical components 66 intersect with reverse helical components 64 at internal nodes 20.

The helical components 62 and rotated helical components 66 do not intersect. Likewise, the reverse helical components 64 and rotated reverse helical components 68 do not intersect.

In addition to the plurality of helical members 60, the preferred embodiment of the member 10 also has six internal axial members 70 located in the interior of the member 10 and intersecting the plurality of helical members 60 at internal nodes 20. The axial members 70 are parallel with the longitudinal axis 14.

The reverse helical components 64 intersect the helical components 62 at external nodes 18 and the rotated reverse helical components 68 intersect the rotated helical components 66 at external nodes 18. The external nodes 18 form the points of the six-pointed star when viewed from the axis 14, as shown in FIG. 2.

The reverse helical components 64 intersect the rotated helical components 66 at internal nodes 20 and the rotated reverse helical components 68 intersect the helical components 62 at internal nodes 20. These internal nodes 20 form the points of the hexagon when viewed from the axis 14, as shown in FIG. 2.

In the preferred embodiment, the external and internal nodes 18 and 20 form rigid connections or the components are rigidly connected together. In addition, the axial members 70 are rigidly coupled to the components at the internal nodes 20. In the preferred embodiment, the components are made from a composite material. The helical configuration of the member 10 makes it particularly well suited for composite construction. The components are coupled together as the fibers of the various components overlap each other. The fibers may be wound in a helical pattern about a mandrel following the helical configuration of the member. This provides great strength because the segments of a component are formed by continuous strands of fiber. The elements or components may be a fiber, such as fiber glass, carbon, boron, or Kevlar, in a matrix, such as epoxy or vinyl ester.

Alternatively, the member 10 may be constructed of any suitable material, such as wood, metal, plastic, or ceramic and the like. The elements of the member may consist of prefabricated pieces that are joined together with connecters at the nodes 18. The connector has recesses formed to receive the elements. The recesses are oriented to obtain the desired geometry of member 10.

Figure 10:
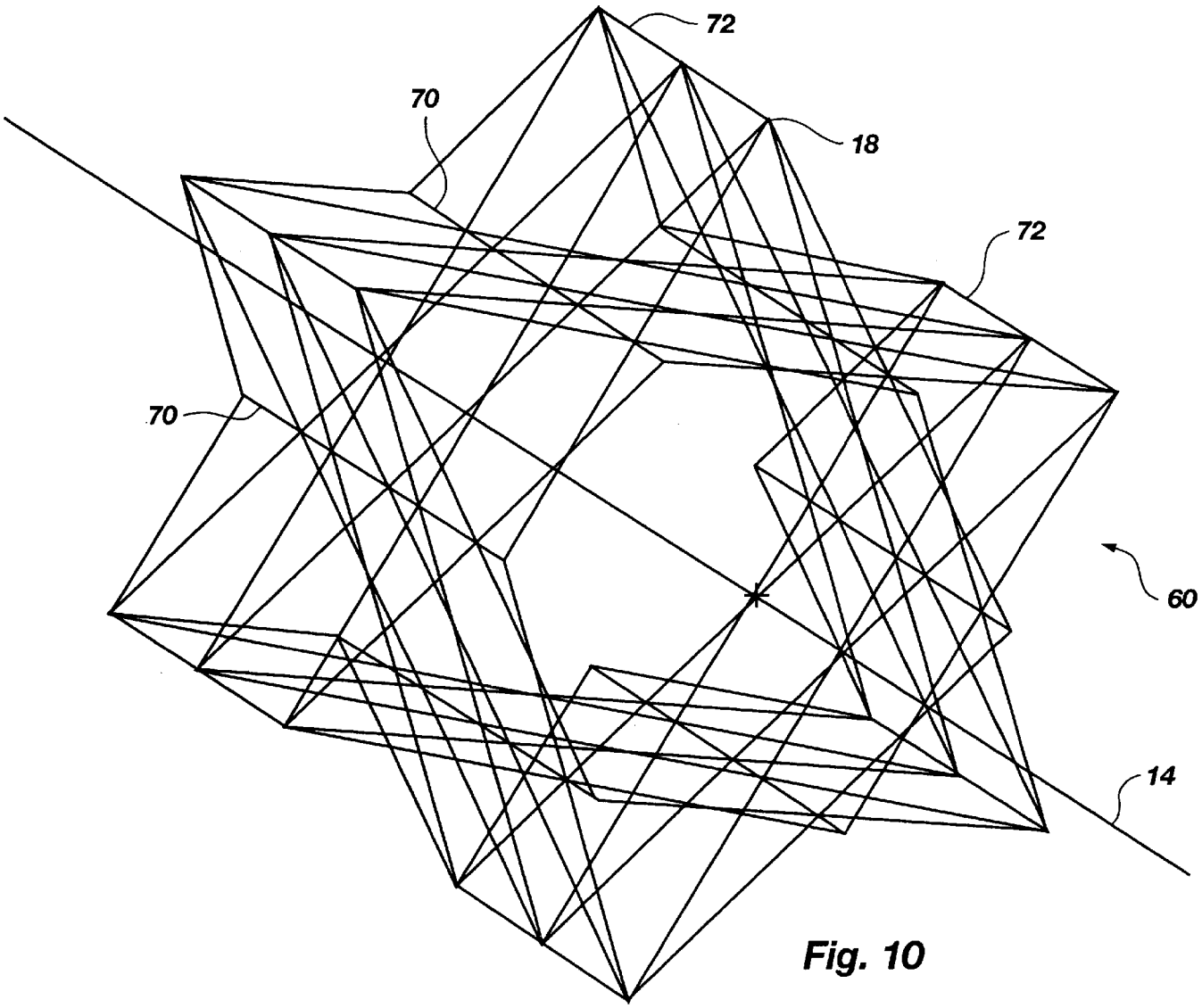
FIG. 10 is a perspective view of an alternative embodiment of a structural member of the present invention.
Figure 11:
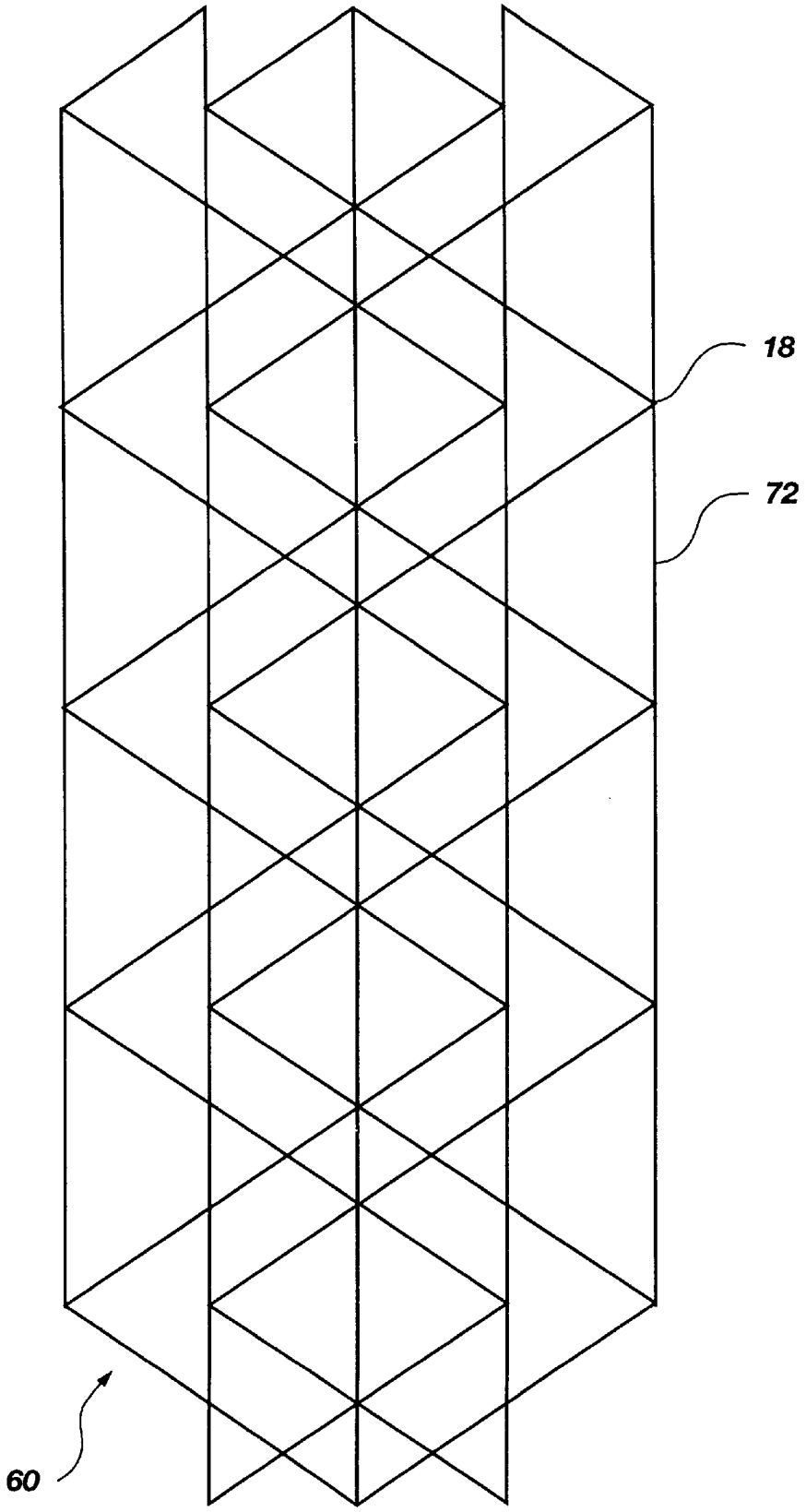
FIG. 11 is a side view of an alternative embodiment of a structural member of the present invention.
Figure 12:
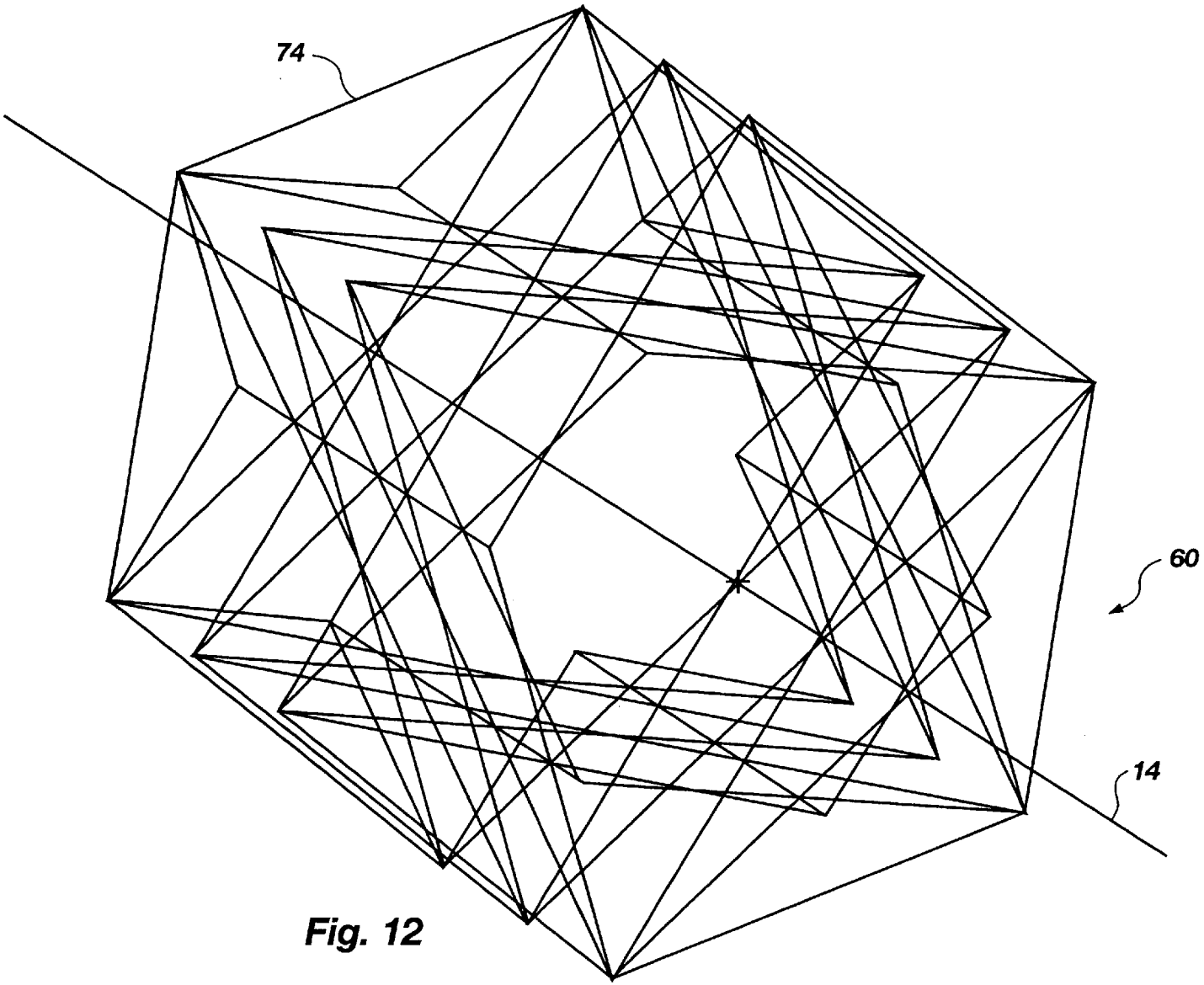
FIG. 12 is a perspective view of an alternative embodiment of a structural member of the present invention.
Figure 13:
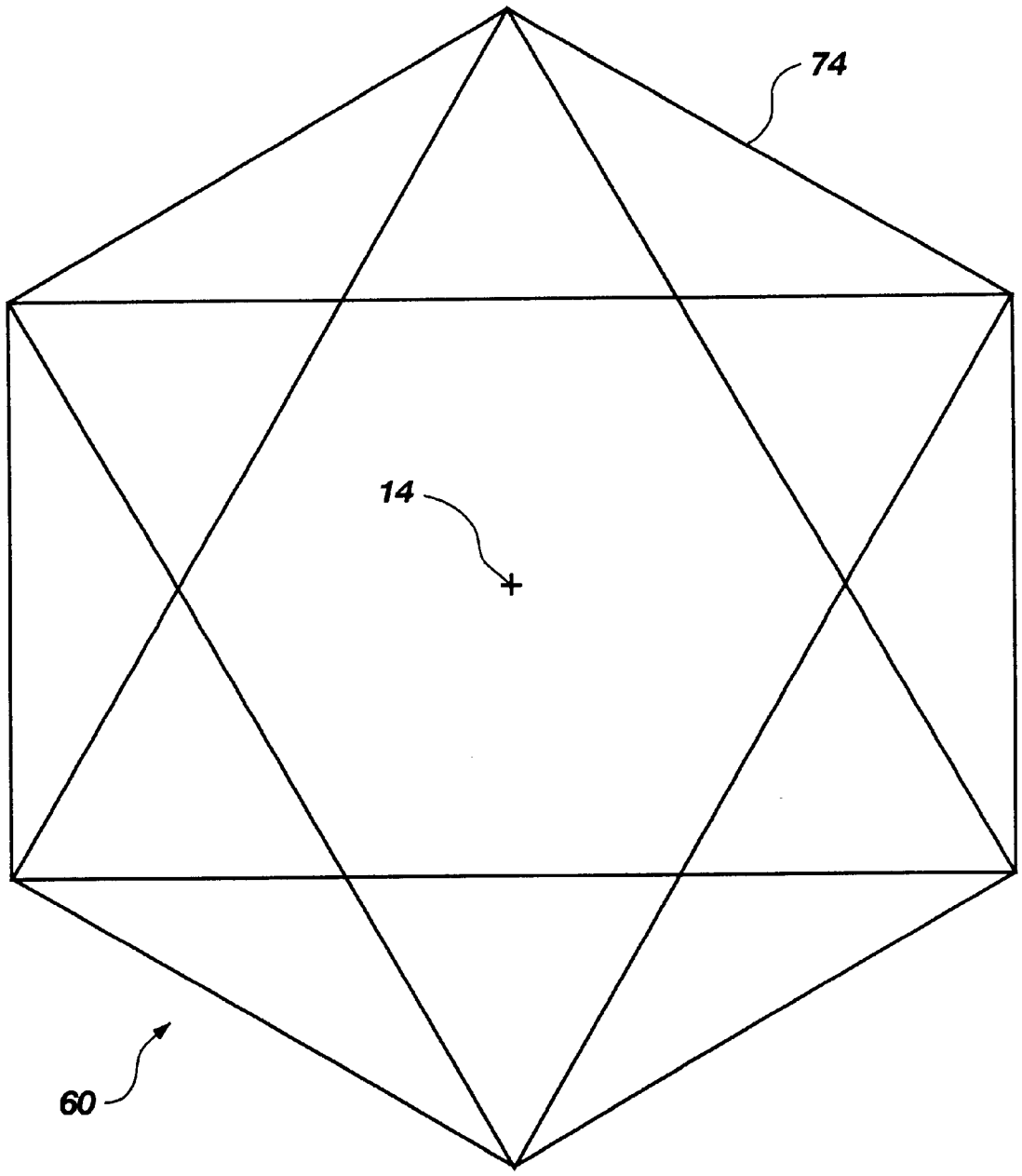
FIG. 13 is an end view of an alternative embodiment of a structural member of the present invention.

From the basic structure 40 of the member 10 of the preferred embodiment, several alternative embodiments are possible with the addition of additional members. Referring to FIGS. 10 and 11, external axial members may also be located at the perimeter of the member 10 and intersect the plurality of helical members 60 at the external nodes 18. The axial members 72 are parallel with the longitudinal axis 14. Referring to FIGS. 12 and 13, perimeter members 74 may be located around the perimeter between nodes 18 that lay in a plane perpendicular to the longitudinal axis 14. The perimeter members 74 form a polyhedron when viewed from the axis 14, as shown in FIG. 13.

Figure 14:
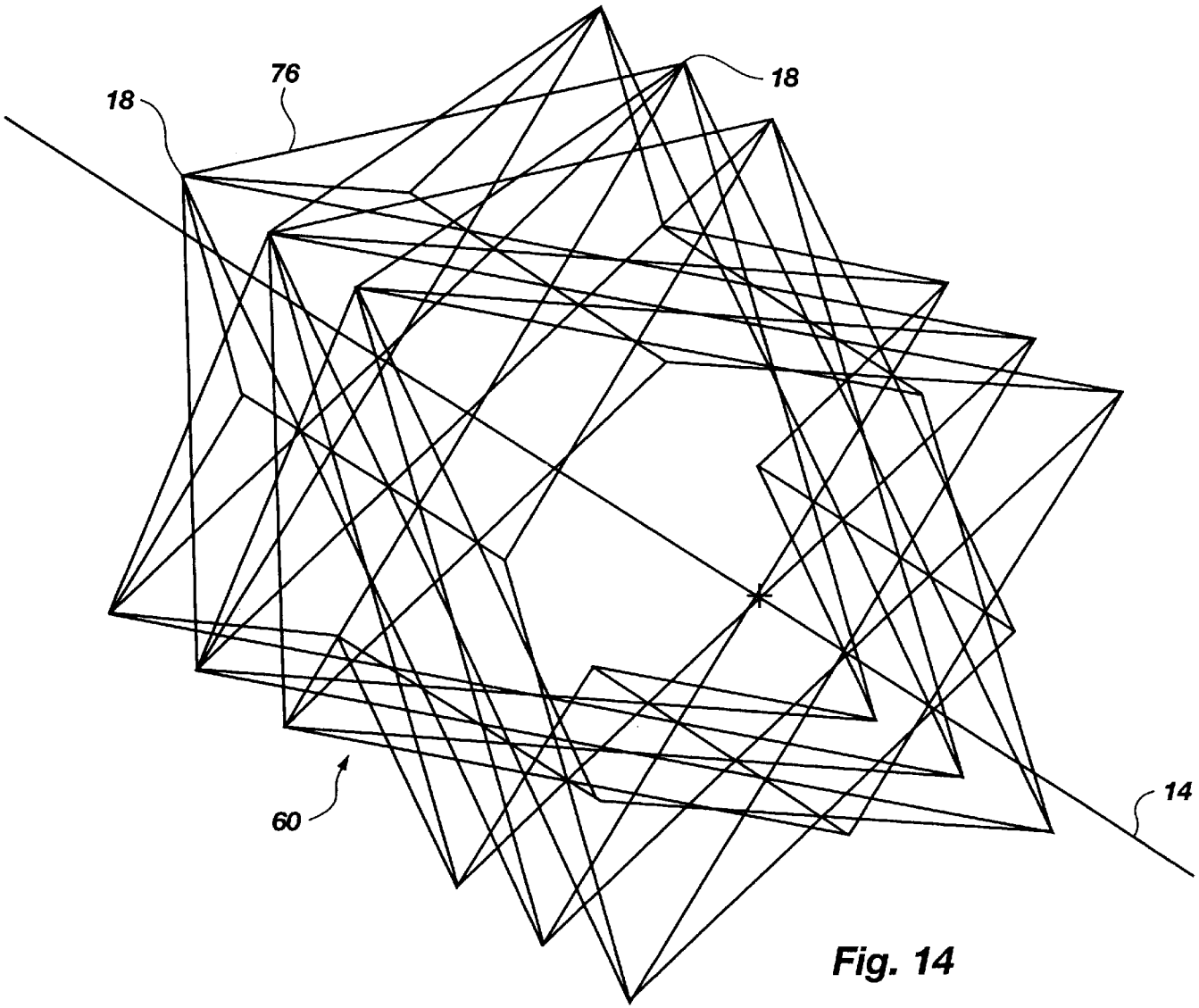
FIG. 14 is a perspective view of an alternative embodiment of a structural member of the present invention.
Figure 15:
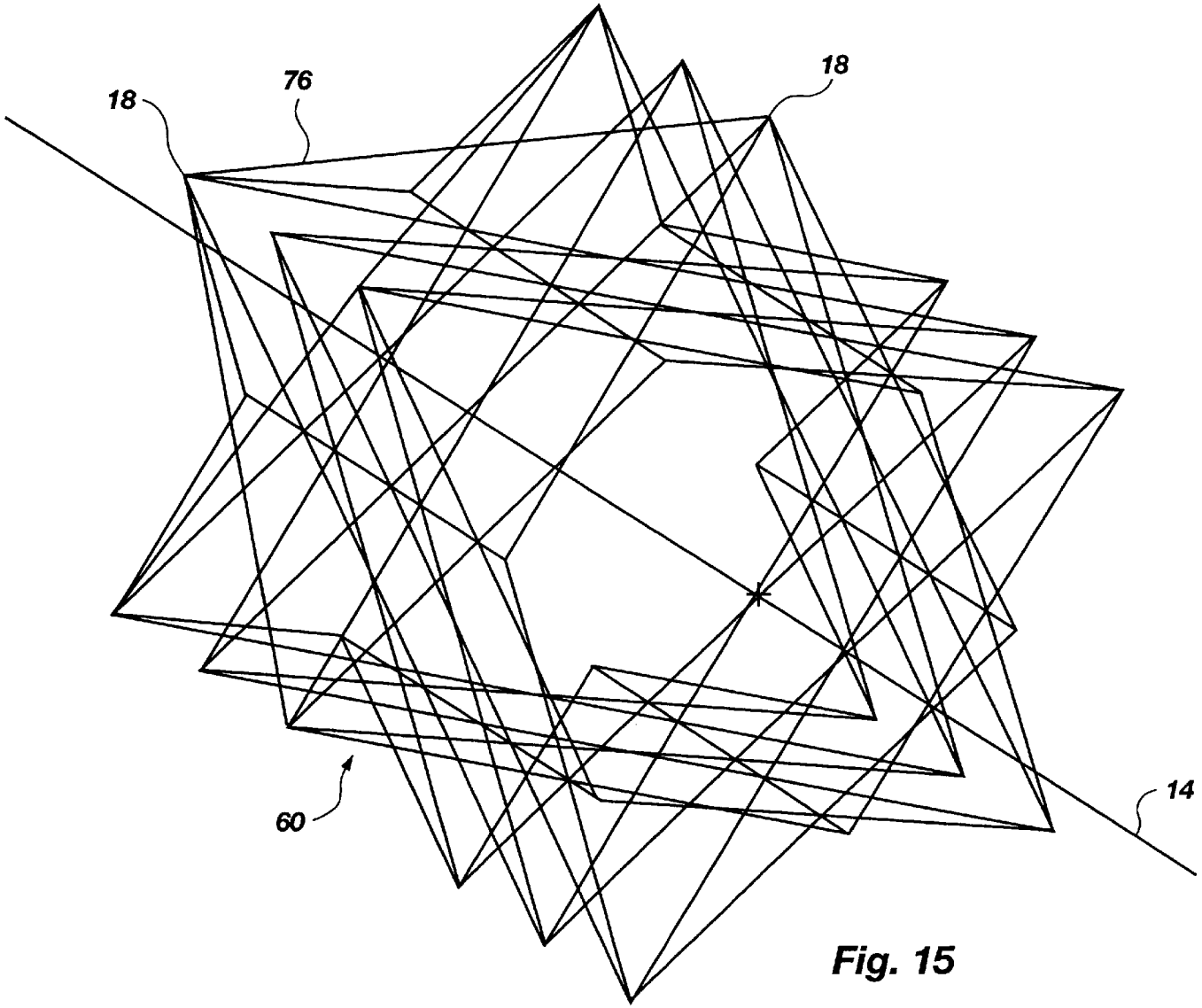
FIG. 15 is a perspective view of an alternative embodiment of a structural member of the present invention.

Referring to FIG. 14, diagonal perimeter members 76 may be located around the perimeter of the member 10 between nodes 18 on a diagonal with respect to the longitudinal axis 14. These diagonal perimeter members 76 may be formed by segments of additional helical components wrapped around the perimeter of the plurality of helical components 60. The diagonal perimeter members 76 may extend between adjacent nodes 18, as shown in FIG. 14, or extend to alternating nodes 18, as shown in FIG. 15.

Figure 16:
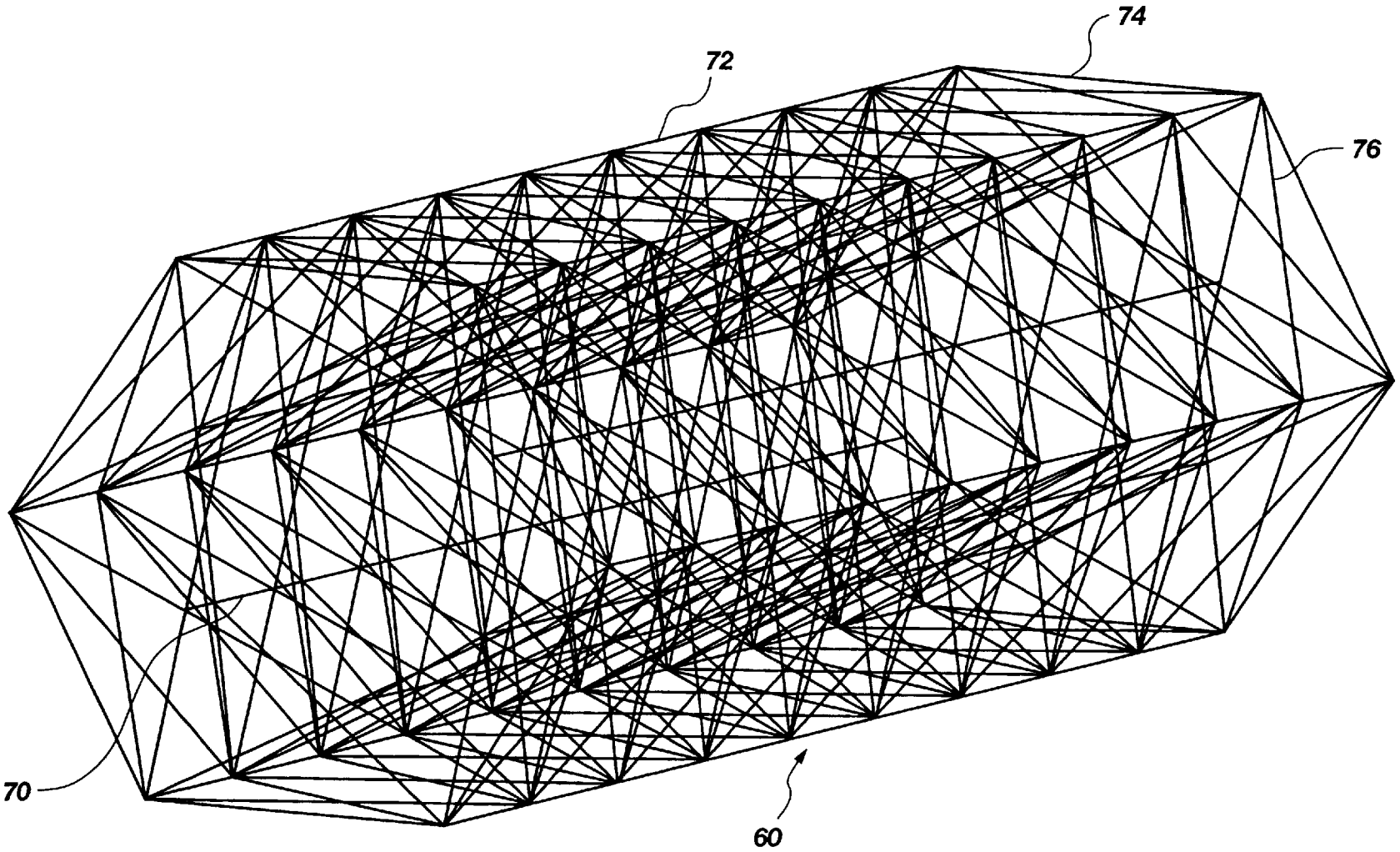
FIG. 16 is a perspective view of an alternative embodiment of a structural member of the present invention.

As illustrated in FIG. 16, many additional members may be combined, such as internal and external axial members 70 and 72, perimeter members 74, and diagonal perimeter members 76.

It is of course understood that additional members may extend between internal nodes 20 as well as external nodes 18.

Figure 17:
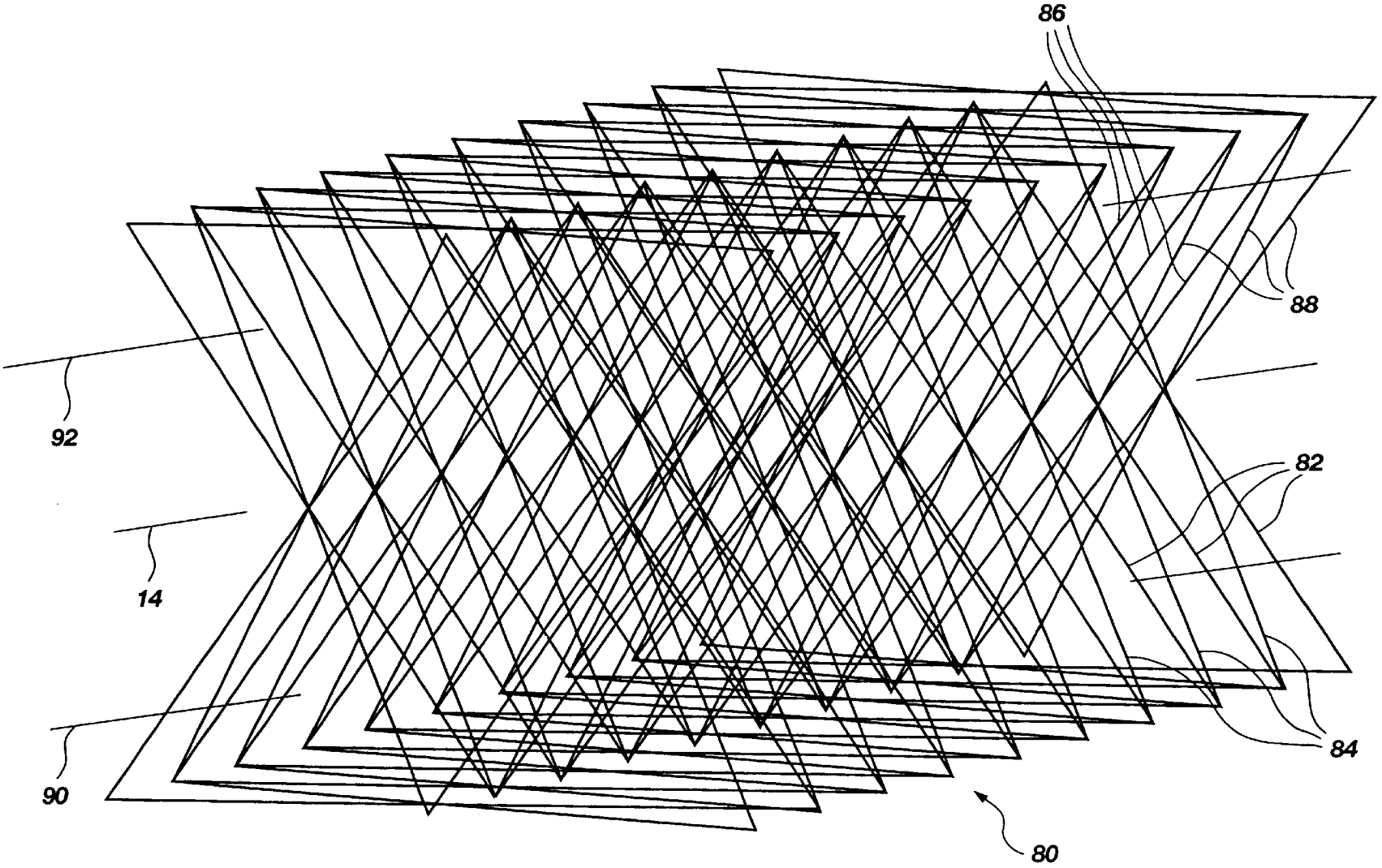
FIG. 17 is a perspective view of an alternative embodiment of a structural member of the present invention.
Figure 18:
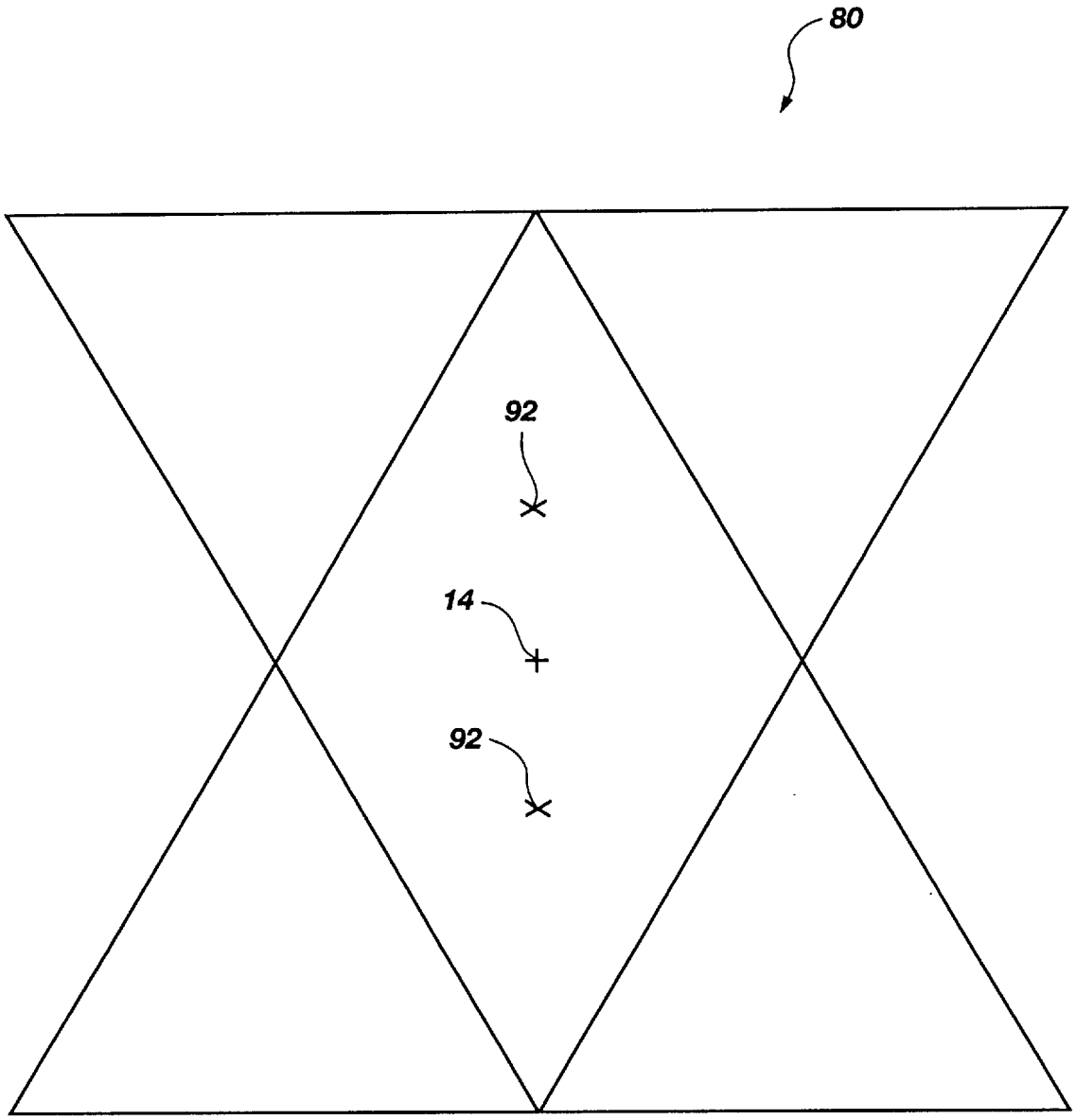
FIG. 18 is an end view of an alternative embodiment of a structural member of the present invention.

As illustrated in FIGS. 17 and 18, an alternative embodiment of a beam member 80 is shown. This embodiment is similar to the preferred embodiment in that the member 80 has at least three helical components 82, at least three reverse helical components 84, at least three rotated helical components 86 and at least three rotated reverse helical components 87. Thus, the member 80 has a total of at least twelve helical components.

The straight segments of the three helical components 82 have a common angular orientation, a common longitudinal axis 90, and are spaced apart from each other at equal distances. Similarly, the segments of the three reverse helical components 84 have a common angular orientation, a common longitudinal axis 90, and are spaced apart from each other at equal distances. But the straight segments of the three reverse helical components 84 have an opposing angular orientation to the angular orientation of the segments of the three helical components 82. Again, this structure, when viewed from the end or axis 14, appears as an imaginary tubular member of triangular cross section.

The straight segments of the three rotated helical components 86 have a common angular orientation, a common rotated longitudinal axis 92, and are spaced apart from each other at equal distances, like the helical components 82. The segments of the three rotated reverse helical components 88 have a common angular orientation, a common rotated longitudinal axis 92, and are spaced apart from each other at equal distances, like the reverse helical components 84. But the straight segments of the three rotated reverse helical components 88 have an opposing angular orientation to the angular orientation of the segments of the three rotated helical components 86.

The rotated helical components 86 and the rotated reverse helical components 88 are rotated with respect to the helical components 82 and reverse helical components 84. In other words, this structure, when viewed from the end or axis 14, appears as an imaginary tubular member of triangular cross section, but is rotated with respect to the imaginary tubular member created by the helical and reverse helical components 82 and 84.

In this embodiment, however, a beam member 80 is created by offsetting the longitudinal axis 90 of the helical and reverse helical components 82 and 84 from the member axis 14 and offsetting the rotated longitudinal axis 92 of the rotated helical and rotated reverse helical components 86 and 88 from the member axis 14 in a direction opposite that of the longitudinal axis 90 of the helical and reverse helical axis 82 and 84. In other words, when viewed from the axis 14, the beam member 80 appears as an imaginary tubular member having a cross section as shown in FIG. 18.

Figure 19:
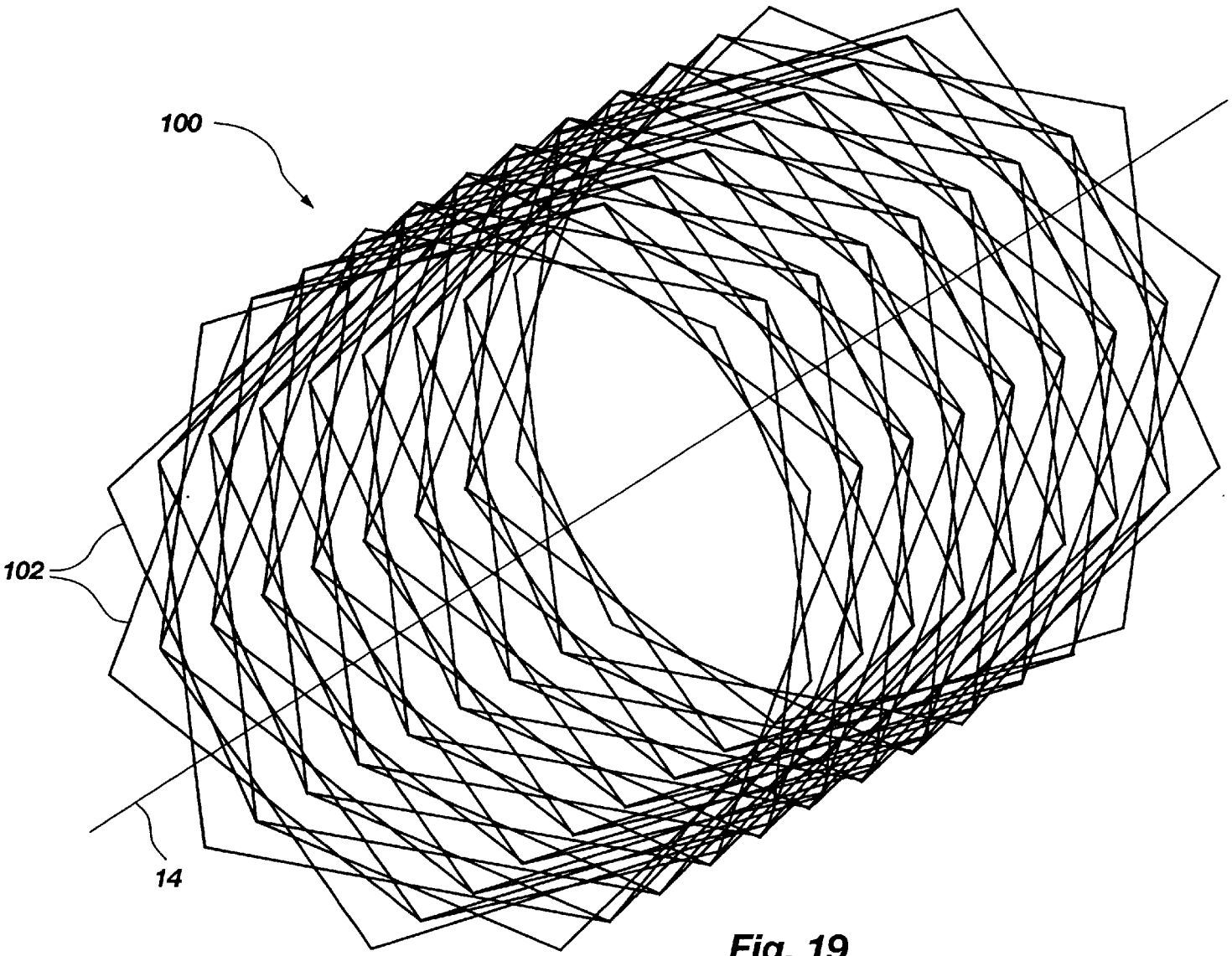
FIG. 19 is a perspective view of an alternative embodiment of a structural member of the present invention.
Figure 20:
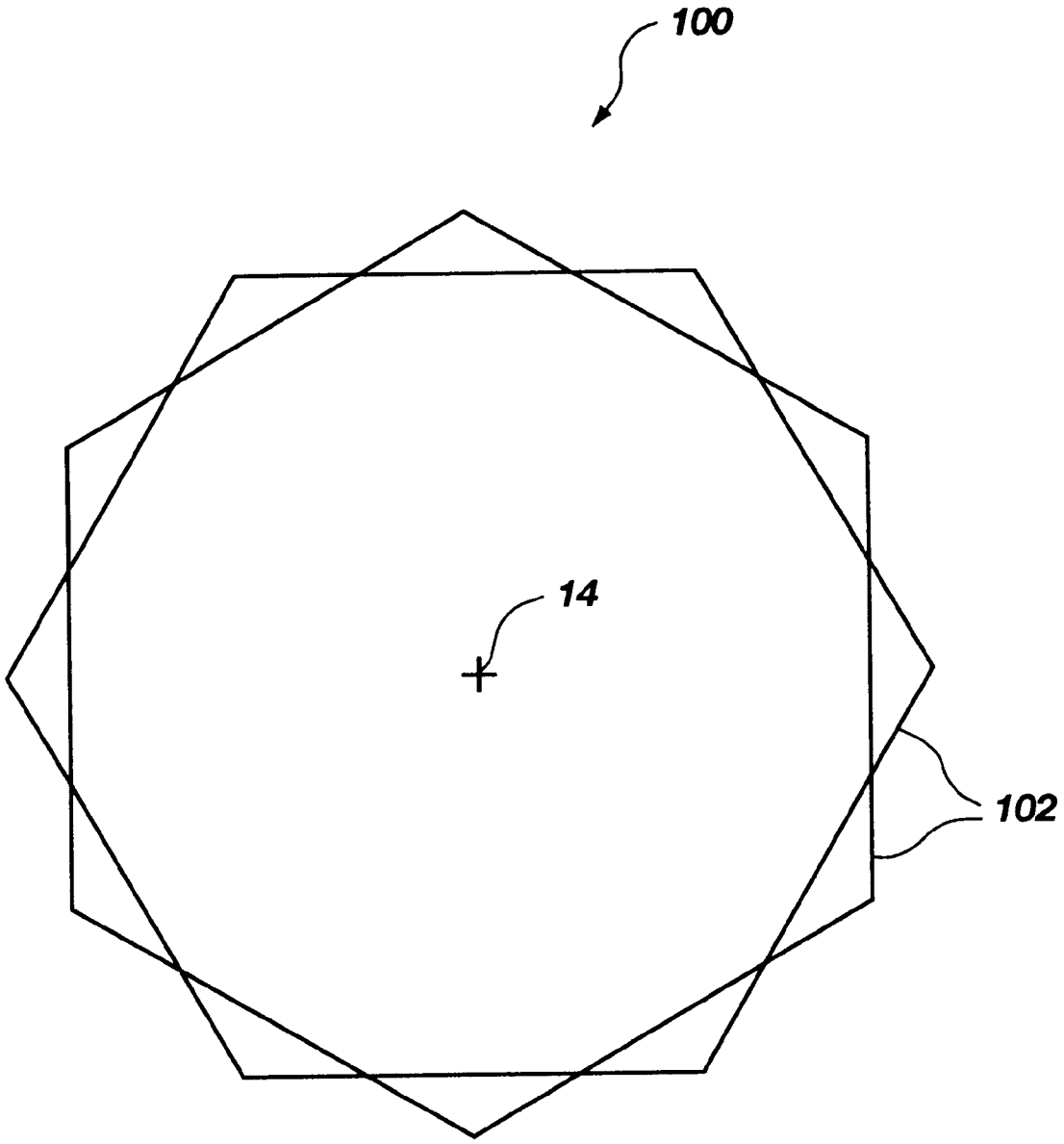
FIG. 20 is an end view of an alternative embodiment of a structural member of the present invention.

As illustrated in FIGS. 19 and 20, an alternative embodiment of a member 100 is shown. This embodiment is similar to the preferred embodiment in that the member has a plurality of helical components 102: six helical components, six reverse helical components, six rotated helical components and six rotated reverse helical components. Thus, the member has a total of twenty four helical components.

As the plurality of helical components 102 wrap around the longitudinal axis 14, the helical components form six straight segments in this embodiment as opposed to three in the preferred embodiment. This member 100, when viewed from the end or axis 14, appears as a two, imaginary tubular member of hexagonal cross section with one hexagon rotated with respect to the other, or as an imaginary tubular member with a cross section of a twelve pointed star, as shown in FIG. 20. As with the preferred embodiment, any number of addition members may be added in various configurations, including internal and external axial members, radial members, and diagonal radial members.

In all the embodiments, a member is obtained with an interior that is considerably void of material while maintaining significant structural properties. The structural member can efficiently bear axial, torsional, and bending loads. This ability to withstand various types of loading makes the structural member ideal for many application having multiple and dynamic loads, such as, a windmill. In addition, its light weight makes it ideal for other applications where light weight and strength is important such as in airplane or space structures.

The open design makes the structural member well suited for applications requiring little wind resistance.

The geometry of the member make it suitable for space structures. The member may be provided with non-rigid couplings so that the member may be collapsible for transportation, and expanded for use.

The member may also be used to reinforce concrete by embedding the member in the concrete. Because of the open design, concrete flows freely through the structure. The multiple load-carrying capabilities would allow for concrete columns and beams to be designed more efficiently.

The appearance of the structural member also allows for architectural applications. The member has a high-tech, or space age, appearance.

The member has mechanical applications as well. The member may be used as a drive shaft due to its torsional strength.

The member may also be wrapped with covering to appear solid. One such covering may be a Mylar coated metal. The covering may be for appearance, or to protect the members and objects carried in the member, such as piping, ducts, lighting and electrical components.

Figure 21:
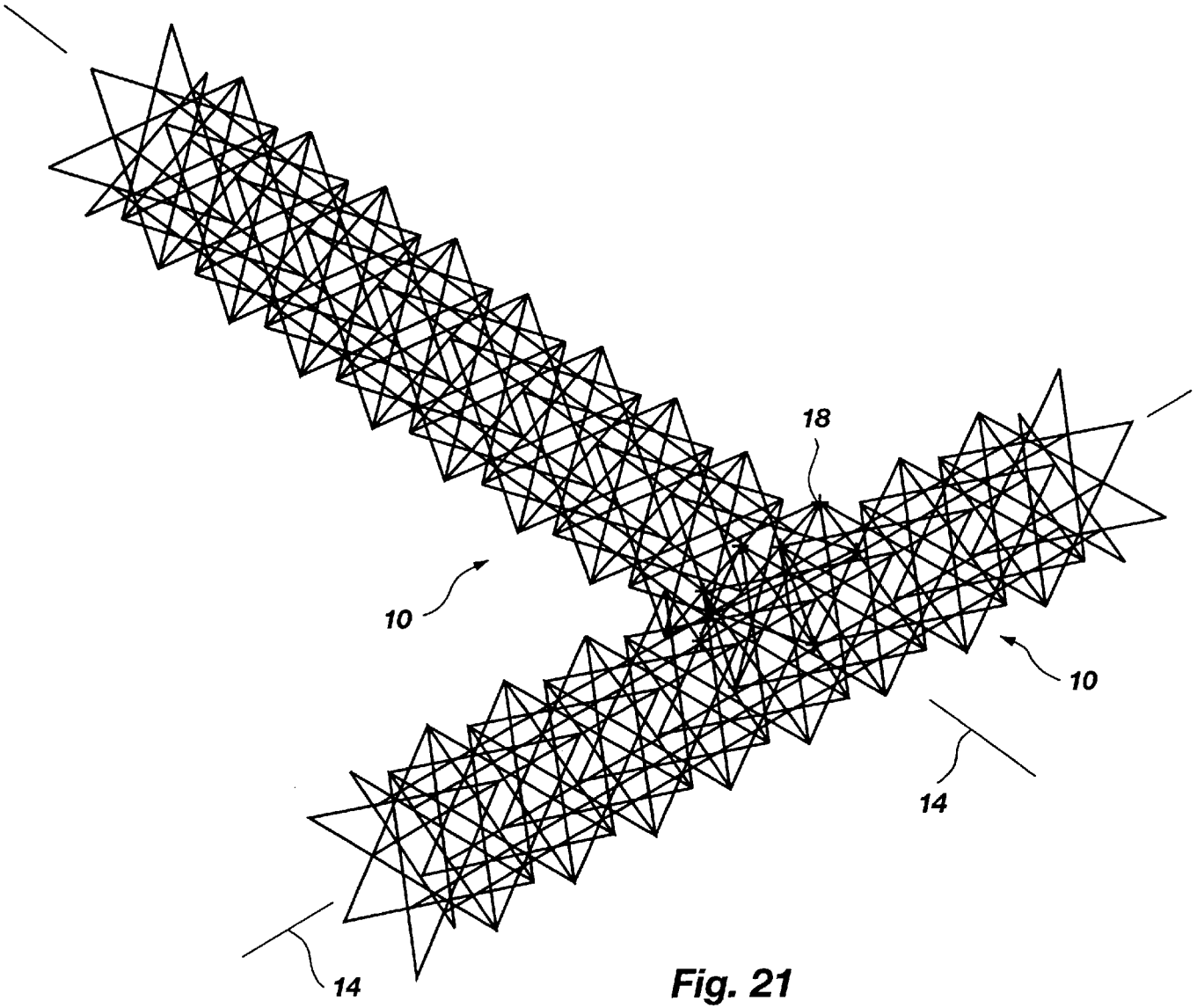
FIG. 21 is a perspective view of two structural members of the preferred embodiment of the present invention connected together.
Figure 22:
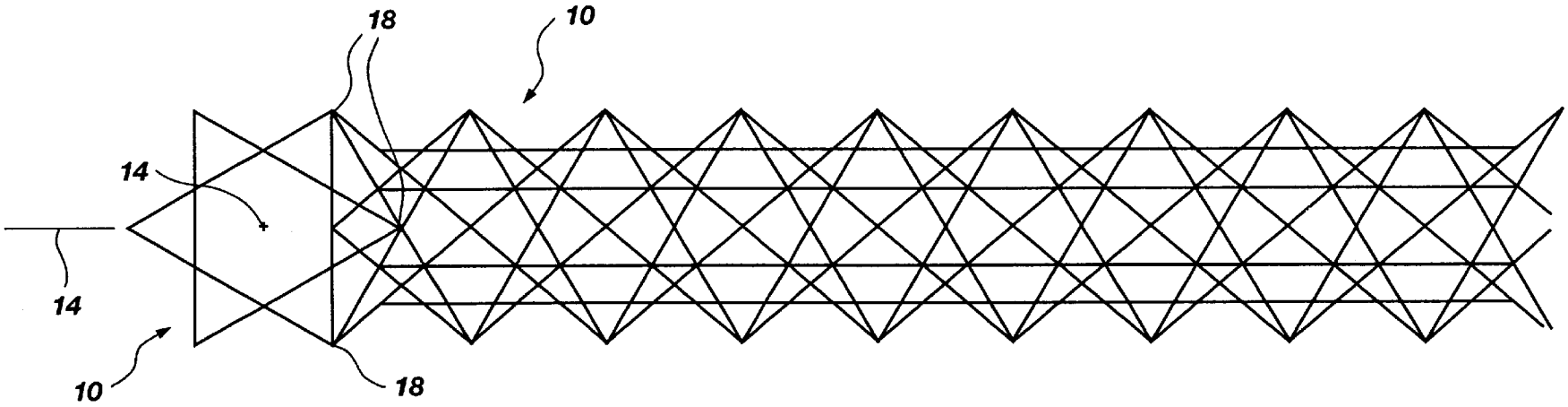
FIG. 22 is a side view of two structural members of the preferred embodiment of the present invention connected together.

As illustrated in FIGS. 21 and 22, two structural members 10 of the preferred embodiment may be attached to form a desired structure. When the two members 10 are connected such that the axis 14 are perpendicular, the external nodes 18 of one member 10 may be attached to the external nodes 18 of the other member 10.

Is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A structural member having greatly enhanced load bearing capacity per unit mass, the structural member comprising:

at least two helical components, each component having at least three elongate, straight segments rigidly connected end to end in a helical configuration, the at least two helical components having a common angular orientation, a common longitudinal axis and being spaced from each other at approximately equal distances, the at least two helical components each having continuous strands of fiber;

at least one reverse helical component having at least three elongate, straight segments rigidly connected end to end in a helical configuration similar to and having a common longitudinal axis with the at least two helical components, but in an opposing angular orientation, the at least one reverse helical component having continuous strands of fiber; and means for coupling the at least two helical components to the at least one reverse helical component at intersecting locations, the means for coupling the helix components and reverse helix components including overlapping the fibers of the helix components and the fibers of the reverse helix components in a matrix; and wherein the at least two helical components and the at least one reverse helical component define a hollow interior which is substantially void of material; and wherein the at least two helical components and the at least one reverse helical component define openings therebetween.

2. The structural member of claim 1, wherein the segments of the at least two helical components and the at least one reverse helical component form an imaginary tubular member of triangular cross section.

3. The structural member of claim 1, wherein the segments of the at least two helical components and the at least one reverse helical component form an imaginary tubular member of polyhedron cross section.

4. The structural member of claim 1, wherein the means for coupling the helix components and reverse helix component includes connectors having sockets positioned and oriented to receive the ends of the components.

5. The structural member of claim 1, further comprising:

at least one axial component coupled to the at least two helical components and the at least one reverse helical component, the at least one axial component being substantially parallel to the longitudinal axis.

6. The structural member of claim 5, wherein the at least one axial component is coupled to the at least two helical components and the at least one reverse helical component at external nodes of the respective helical and reverse helical components.

7. The structural member of claim 5, wherein the at least one axial component is coupled to the at least two helical components and the at least one reverse helical component at internal nodes of the respective helical and reverse helical components.

8. The structural member of claim 1, further comprising:

at least one additional component coupled between adjacent nodes of the at least two helical components and the at least one reverse helical component.

9. The structural member of claim 8, wherein the additional component is a perimeter member coupled between two nodes of the helical and reverse helical components in a plane perpendicular to the longitudinal axis.

10. The structural member of claim 8, wherein the additional component is a diagonal perimeter member coupled between two nodes of the helical and reverse helical components and oriented at an angle with respect to the longitudinal axis.

11. A structural member having greatly enhanced load bearing capacity per unit mass, the structural member comprising:

at least two helical components, each component having at least three elongate, straight segments rigidly connected end to end in a helical configuration, the at least two helical components having a common angular orientation, a common longitudinal axis and being spaced from each other at approximately equal distances;

at least one reverse helical component having at least three elongate, straight segments rigidly connected end to end in a helical configuration similar to and having a common longitudinal axis with the at least two helical components, but in an opposing angular orientation;

means for coupling the at least two helical components to the at least one reverse helical component at intersecting locations;

at least two rotated helical components, each component having at least three elongate, straight segments rigidly connected end to end in a helical configuration, the at least two rotated helical components having a common angular orientation, a common rotated longitudinal axis and being spaced from each other at approximately equal distances, the segments of the at least two rotated helical components being rotated with respect to the segments of the at least two helical components;

at least one rotated reverse helical component having at least three elongate, straight segments rigidly connected end to end in a helical configuration similar to and having a common rotated longitudinal axis with the at least two rotated helical components, but in an opposing angular orientation, the segments of the at least one rotated reverse helical component being rotated with respect to the segments of the at least one reverse helical components; and means for coupling the at least two rotated helical components and the at least one rotated reverse helical component to the at least two helical components and the at least one reverse helical component at intersecting locations.

12. The structural member of claim 11, wherein the longitudinal axis and the rotated longitudinal axis are concentric and the segments of the at least two helical components, the at least one reverse helical component, the at least two rotated helical components, and the at least one rotated reverse helical component form an imaginary tubular member having a cross section of a six-pointed star.

13. The structural member of claim 11, wherein the longitudinal axis and the rotated longitudinal axis are concentric and the segments of the at least two helical components, the at least one reverse helical component, the at least two rotated helical components, and the at least one rotated reverse helical component form an imaginary tubular member having a cross section of two polyhedrons having a common longitudinal axis but with one polyhedron rotated with respect to the other.

14. The structural member of claim 11, wherein the longitudinal axis and the rotated longitudinal axis are concentric and the segments of the components intersect at the end of the segments to form exterior nodes, a plurality of planes extend between select exterior nodes, the planes being parallel with the longitudinal axis and the rotated longitudinal axis, the segments being disposed in the plurality of planes, three of the plurality of planes being oriented to form a first imaginary tubular member of triangular cross section and another three of the plurality of planes being oriented to form a second imaginary tubular member of triangular cross section, the first imaginary tubular member and the second imaginary tubular member having a common axis, the second imaginary tubular member being rotated about the common axis with respect to the first imaginary tubular member.

15. The structural member of claim 11, wherein the longitudinal axis and the rotated longitudinal axis are parallel and spaced apart, the segments of the components intersect at the end of the segments to form exterior nodes, a plurality of planes extend between select exterior nodes, the planes being parallel with the longitudinal axis and the rotated longitudinal axis, the segments being disposed in the plurality of planes, three of the plurality of planes being oriented about the longitudinal axis to form a first imaginary tubular member of triangular cross section and another three of the plurality of planes being oriented about the rotated longitudinal axis to form a second imaginary tubular member of triangular cross section.

16. The structural member of claim 11, wherein the components are fiber in a matrix.

17. The structural member of claim 11, wherein the components are fiber in a matrix and the means for coupling the helix components and reverse helix component includes overlapping the fibers of the helix components and the fibers of the reverse helix components in the matrix.

18. The structural member of claim 11, wherein the means for coupling the helix components and reverse helix component includes connectors having sockets positioned and oriented to receive the ends of the components.

19. The structural member of claim 11, further comprising:

at least one axial component coupled to the at least two helical components, the at least one reverse helical component, the at least two rotated helical components, and the at least one rotated reverse helical component, the at least one axial component being substantially parallel to the rotated longitudinal axis.

20. The structural member of claim 19, wherein the at least one axial component is coupled to at least one of (i) the at least two helical components, (ii) the at least one reverse helical component, (iii) the at least two rotated helical components, and (iv) the at least one rotated reverse helical component at external nodes of the respective helical, reverse helical, rotated helical, and rotated reverse helical components.

21. The structural member of claim 19, wherein the at least one axial component is coupled to at least one of (i) the at least two helical components, (ii) the at least one reverse helical component, (iii) the at least two rotated helical components, and (iv) the at least one rotated reverse helical component at internal nodes of the respective helical, reverse helical, rotated helical, and rotated reverse helical components.

22. The structural member of claim 11, further comprising:

at least one additional component coupled between adjacent nodes of any combination of (i) the at least two helical, (ii) the at least one reverse helical, (iii) the at least two rotated helical, and (iv) the at least one rotated reverse helical components.

23. The structural member of claim 22, wherein the additional component is a perimeter member coupled between at least two nodes of any combination of the helical, reverse helical, rotated helical, and rotated reverse helical components in a plane perpendicular to the longitudinal axis.

24. The structural member of claim 22, wherein the additional component is a diagonal perimeter member coupled between at least two nodes of any combination of the helical, reverse helical, rotated helical, and rotated reverse helical components and oriented at an angle with respect to the longitudinal axis.

* * * * *

UNITED STATES PATENT AND TRADEMARK OFFICE

CERTIFICATE OF CORRECTION

PATENT NO. : 5,921,048
DATED : July 13, 1999
INVENTOR(S) : Larry R. Francom and David E. Jensen It is certified that error appears in the above-identified patent and that said Letters Patent is hereby corrected as shown below:

Title page, Item [54] and Column 1, line 1,
Change the title of the patent to:
-- THREE-DIMENSIONAL ISO-TRUSS STRUCTURE --

Signed and Sealed this

Tenth Day of September, 2002

*Attest:*

*Attesting Officer*

JAMES E. ROGAN
*Director of the United States Patent and Trademark Office*